US005472173A

United States Patent [19]

Laszlo

[11] Patent Number: 5,472,173

[45] Date of Patent: Dec. 5, 1995

[54] SLAG CONTROL METHOD AND APPARATUS

[75] Inventor: William S. Laszlo, Lockport, Ill.

[73] Assignee: Industrial Maintenance and Contract Services, Munster, Ind.

[21] Appl. No.: 225,670

[22] Filed: Apr. 11, 1994

Related U.S. Application Data

[63] Continuation-in-part of Ser. No. 178,911, Jan. 7, 1994, abandoned, which is a continuation-in-part of Ser. No. 84,348, Jun. 28, 1993, Pat. No. 5,375,818, which is a continuation-in-part of Ser. No. 832,719, Feb. 7, 1992, Pat. No. 5,240,231, and a continuation-in-part of Ser. No. 912,844, Aug. 7, 1992, abandoned, which is a continuation-in-part of Ser. No. 560,598, Jul. 31, 1990, Pat. No. 5,173,243, said Ser. No. 832,719 is a continuation-in-part of Ser. No. 722,524, Jun. 27, 1991, Pat. No. 5,173,244, which is a continuation-in-part of Ser. No. 560,598.

[51] Int. Cl.[6] ..... C21B 3/04

[52] U.S. Cl. ..... 266/45; 266/287; 266/231; 266/236

[58] Field of Search ..... 266/45, 227, 231, 266/236

[56] References Cited

U.S. PATENT DOCUMENTS

| | | | |
|---|---|---|---|
| 1,690,748 | 11/1928 | Moyer | 266/231 |
| 5,173,243 | 12/1992 | Laszlo | 266/45 |
| 5,173,244 | 12/1992 | Laszlo | 266/45 |
| 5,240,231 | 8/1993 | Laszlo | 266/45 |

FOREIGN PATENT DOCUMENTS

| | | | |
|---|---|---|---|
| 4354811 | 12/1992 | Japan | 266/231 |

OTHER PUBLICATIONS

Laszlo et al. "A Device To Separate Slag From Liquid Metal" Article Presented at the Meeting of the American Institute of Metallurgical Engineers, Nov. 1993, pp. 1–7.

*Primary Examiner*—Scott Kastler
*Attorney, Agent, or Firm*—Dressler, Goldsmith, Shore & Milnamow, Ltd.

[57] ABSTRACT

A method and apparatus are provided for separating molten metal and slag from a rotating furnace. The apparatus includes a vessel having a reservoir which is positioned to receive a free-falling flow of molten metal and slag as it exits a tap hole in the furnace. The reservoir has a predetermined flow path therethrough, a molten metal outlet, a slag opening and a drain hole. The flow path includes a first portion having an open top for receiving the flow of molten metal and slag. The first portion is configured to eliminate turbulence caused by the free-falling flow of molten metal and slag into the reservoir and to permit separation of the molten metal from the slag wherein the slag floats on top of the molten metal. The molten metal is collected from the metal outlet for further processing and the slag is collected for disposal. In order to drain any residual molten metal and slag from the reservoir, a lifting and tilting mechanism is provided to position the apparatus so that the drain hole can be opened for discharge into a desired container.

66 Claims, 18 Drawing Sheets

SLAG CONTROL METHOD AND APPARATUS

CROSS-REFERENCE TO RELATED APPLICATIONS

This application is a continuation-in-part of U.S. patent application Ser. No. 08/178,911, filed Jan. 7, 1994, now abandoned, which is a continuation-in-part of U.S. patent application Ser. No. 08/084,348, filed Jun. 28, 1993 issued as U.S. Pat. No, 5,375,818, which is a continuation-in-part of U.S. patent application Ser. No. 07/832,719, filed Feb. 7, 1992 and issued as U.S. Pat. No. 5,240,231, and U.S. patent application Ser. No. 07/912,844, filed Aug. 7, 1992 and now abandoned. Ser. No. 07/832,719 is a continuation-in-part of Ser. No. 07/722,524, filed Jun. 27, 1991 and issued as U.S. Pat. No. 5,173,244, which is a continuation-in-part of Ser. No. 07/560,598, filed Jul. 31, 1990 and issued as U.S. Pat. No. 5,173,243. Ser. No. 07/912,844 is a continuation of Ser. No. 07/560,598. The specifications of Ser. No. 08/178,911, Ser. No. 08/084,348, Ser. No. 07/832,719, Ser. No. 07/912,844, Ser. No. 07/722,524, and Ser. No. 07/560,598 are incorporated herein by reference.

TECHNICAL FIELD

The present invention relates generally to a method and apparatus for removing slag that separates from molten metal. The method and apparatus are particularly suitable for removing slag that separates from molten metal which is discharged from a tilting electric arc furnace, rotatable furnace or the like.

BACKGROUND OF THE INVENTION

When scrap metal is heated to a liquid, molten state, certain impurities may be separated from the molten metal by the introduction of conventional fluxes which react with the impurities to form what is conventionally known as furnace slag. This slag rises to the surface and floats on top of the molten metal.

Slag is of little or no value in making use of the molten metal from the furnace. To the contrary, furnace slag can interfere with alloy additives in various metal specifications.

For example, in making alloyed steel, soluble oxygen is an unwanted contaminant. Slag which rises to the top of molten steel contains a large amount of soluble oxygen. If slag is present when alloys are added to the molten steel, then the soluble oxygen in the slag will react with the alloys and inhibit the alloys from reacting with the molten steel. Thus, the slag inhibits the alloying process. Also, the presence of slag in the molten steel facilitates the formation of particulate inclusions which, if large enough, may be detrimental to the physical properties of the steel.

Since furnace slag is a contaminant which may have a deleterious effect on making alloy steels, it is desirable to separate the slag from the molten metal before alloys are added to the molten metal. Therefore, slag separation is usually effected before alloys are added to the molten steel. Any slag which is separated is usually discarded. The process of separating slag from molten steel is often known as slag control.

Slag control has been a particularly difficult problem when scrap steel is melted in tilting furnaces and then discharged into a container or "ladle" before adding alloys.

As discussed below, there have been numerous attempts at separating slag from molten steel that is discharged from a tilting furnace.

The typical electric furnace is mounted on a tilting platform. A tap hole is located on the side of the furnace. A discharge trough is mounted on the side of the furnace, just below the tap hole.

When the furnace is heated, scrap steel in the furnace melts into a molten liquid state. Slag separates from the molten steel and floats in a separate layer on top of the molten steel.

The tap hole is opened when the furnace is in the upright position. When the tap hole is opened, it is usually located above the level of the floating slag and molten metal. However, in some cases, it may be located below the level of the floating slag.

When the furnace is tilted, the operator of the furnace will attempt to tilt the furnace sufficiently so that the tap hole is below the top of the molten metal and permits the molten steel to flow through the tap hole. The slag remains inside the furnace and floats at a level above the level of the tap hole. As the molten steel drains from the furnace, the operator increases the angle of tilt in order to keep the slag at a level above the level of the tap hole. Thus, the operator attempts to cause all of the molten steel to flow through the tap hole before the slag begins to flow through the tap hole. This process of pouring or tapping is conventionally known as the "tap".

As slag floats on top of molten steel, there is a very fluid layer of floating slag, known as interface slag, which floats in a layer between the molten steel and the rest of the floating slag. The interface slag has much less viscosity, and a higher concentration of soluble oxygen, than the rest of the floating slag. Interface slag is particularly deleterious to the alloying process.

While molten steel is flowing through the tap hole, a vortex forms. The vortex draws interface slag through the tap hole while the molten steel is flowing through the tap hole.

The operator cannot see the vortexing of the interface slag because the furnace is usually enclosed on all sides and the top. Therefore, there is very little that the operator can do to prevent the interface slag from contaminating the molten steel during the tap.

During the tap, the level of the molten metal and floating slag in the furnace falls until the floating slag is at the level of the tap hole. At this point, the floating slag will begin to flow through the tap hole and contaminate the molten steel which has already been poured from the furnace. In order to prevent the flow of slag through the tap hole, the operator attempts to stop the tapping process quickly by closing the tap hole and/or returning the furnace to the upright position.

However, because a tilting furnace is usually fully enclosed, the operator usually cannot see inside the furnace to determine exactly when the slag is about to flow through the tap hole. Therefore, the operator usually waits until he sees slag coming out of the tap hole and into the trough before attempting to stop the flow of slag and returning the furnace to the upright position. This is the traditional method of slag control in a tilting furnace.

There have been numerous attempts to supplement or improve this basic method of slag control on tilting furnaces, including the use of tap hole gates, Vost-Alpine slag stoppers, the E-M-L-I system, and various stopper devices or plugs.

Tap hole gates are sliding or rotary gates which are mounted on the outside of the furnace adjacent the tap hole. The operator closes the gate when slag begins to discharge from the tap hole.

The Vost-Alpine slag stopper is a large, articulating nitrogen gas cannon which is used to close the tap hole. Operating under very high pressure, the cannon discharges nitrogen gas into the tap hole of the furnace on demand, and this stops the flow of molten steel and slag through the tap hole. Thus, the Vost-Alpine slag stopper is functionally analogous to a tap hole gate.

The E-M-L-I system consists of an electronic sensor which is mounted to the furnace inside the tap hole refractory. The E-M-L-I senses when a predetermined percentage of slag is entrained in the molten metal which is flowing through the tap hole. When the predetermined percentage is sensed by the E-M-L-I unit, the sensor communicates this to the operator of the furnace, who will then return the furnace to the upright position. Thus, the E-M-L-I system is used to control slag by directing the operator of the furnace to stop flow through the tap hole as soon as a predetermined amount of slag begins to flow through the tap hole.

A variety of stopper devices or plugs are used to control slag. They have a variety of shapes including the shapes of a tetrahedron or globe (also known as "cannonball"). A plug is placed inside the furnace and floats in the interface between the molten metal and floating slag. When the interface and plug drop to the level of the tap hole during the course of a tap, the plug is drawn by suction to the tap hole and blocks flow through the tap hole.

The eccentric bottom tapping gate is another attempt at slag control in an electric arc furnace. It requires that the tap hole be made in the bottom, rather than the side, of the furnace. When the operator observes slag pouring from the furnace, he closes a sliding gate to block the tap hole and prevent further flow through the tap hole. This method of slag control is quite expensive because it requires modification of an existing furnace to create a virtually new furnace and new ladle transfer cars or turrets to receive the molten steel as it is discharged from the furnace. The ladles must be moved from the side of the furnace and placed underneath the bottom of the furnace.

Although the preceding background information has been presented with respect to a typical tilting electric furnace, such background information also applies to any basic oxygen process (BOP) including use with a rotating furnace or any other type of furnace. In a rotating furnace, the tap hole is located toward the top of the furnace which rotates about a central horizontal axis.

Typically, a trough is not attached to a rotating furnace. Instead, one or more containers or "ladles" are positioned beneath the furnace so that upon rotation of the furnace the tap hole initially pours molten metal onto a trough or directly into the ladle. Once slag or a combination of molten metal and slag begins to flow from the tap hole, the operator either stops the pour or directs the flow into another container separate from the ladle. Thus, with a rotating furnace, care must be exercised in the positioning of the ladle or trough so that the flow out of the furnace tap hole is directed into the ladle or trough.

Additionally, in a rotating furnace, the flow of molten metal and slag is a free-falling flow from the furnace to the ladle or trough below. The flow impacts with the ladle with a substantial force which creates a very turbulent mixing action between the molten metal and slag within the ladle. Before any separating of the molten metal and slag can occur, the turbulence from the flow must be substantially reduced or eliminated.

Furthermore, as the flow of furnace contents out of a rotating furnace continues, the furnace must continue to be rotated to drain all of the contents out of the furnace. As the furnace rotates, however, the point of impact between the flow of the furnace contents and the ladle moves horizontally toward the direction of rotation of the furnace. Thus, the ladle or trough must be small enough to fit under the furnace throughout its rotation yet large enough to accommodate movement of the point of impact. Alternatively, the ladle must be capable of being moved to correspond to the movement of the point of impact of the flow.

None of these prior methods of slag control for a tilting furnace have performed particularly well. None of them solves the problem of contamination of the molten steel with interface slag which vortexes through the tap hole while the molten steel is flowing through the tap hole. None of them solves the problem of contamination of the molten steel with slag which flows through the tap hole at the end of a tap before the operator can react to stop the flow through the tap hole. Most of these methods also stop the flow of some of the molten steel, thus reducing the yield.

The above-described prior art methods and apparatuses do not control slag after it escapes through the tap hole of a tilting furnace. Instead, they simply function to attempt to stop flow through the tap hole when it is determined that most of the molten steel has been discharged through the tap hole and floating slag is beginning to flow through the tap hole. None of these prior art methods and apparatuses control or remove the slag from the flow after the flow has been discharged through the tap hole and into the trough.

It would be desirable to control slag in a tap discharge of molten metal after it flows through the tap hole into the trough and before it flows out of the trough and into the ladle.

It would also be beneficial if such an improved system could be effectively and readily employed on a tilting electric arc furnace having an attached discharge trough.

Additionally, such an improved system should provide for positive separation and control of the slag, including interface slag, from the molten metal.

Further, it would be desirable to provide an improved system which would permit the viewing of the level of molten metal and floating slag in the trough in order to coordinate the separation of the slag and metal, as well as the retention and discharge of the slag in a positive manner.

It would be beneficial to provide such a system which can be implemented by apparatus that can be removed and replaced as necessary, without requiring removal or replacement of the entire trough or furnace.

In particular, it would be desirable to provide a slag control system which can operate relatively efficiently and in a manner that will accommodate a relatively high flow rate in the tap discharge so as to minimize the total time required for the tap discharge (i.e., pour time). This would serve to reduce the amount of heat absorbed by the system; such as the refractory brick and steel supporting frame. This would also reduce the thermal cycle peaks and minimize the thermal degradation and wear of the materials.

In addition, a reduced tap discharge time can reduce the amount of gases absorbed by the molten metal in the trough, as well as in the ladle. In particular, it would be desirable to reduce the amount of nitrogen and oxygen absorbed by molten steel during tap discharges.

It would also be beneficial to provide a slag control system that would accommodate relatively high flow rates, and therefore reduce the total tap discharge time, so as to prevent an excessive temperature drop in the molten metal flowing along the trough as well as in the molten metal in the ladle. If high enough flow rates can be accommodated through an improved slag control system, the need to reheat the steel in the ladle may be eliminated or at least minimized.

For example, in one type of conventional electric arc furnace having a tap hole with a diameter of between 8 inches and 12 inches and having a conventional open trough, a tap discharge of 80 tons of molten slag and steel might require about 3 minutes. It would be desirable to provide an improved slag control system which, during operation, would not add significantly to the tap discharge time.

It would also be desirable to provide an improved slag control system which could readily accommodate designs employing sufficient thicknesses of refractory materials reduce heat transfer from the molten steel and to provide sufficiently rugged designs that can better withstand the effects of the hot flowing metal and high temperatures.

Further, it would be advantageous if an improved slag control system would be provided with the capability for eliminating or substantially minimizing irregularities in molten metal flow. Such flow irregularities are undesirable and can contribute to entraining slag into the molten metal through vortex effects or through other effects. The likelihood of entraining slag, or drawing interface slag, into the molten metal increases with time near the end of the tap discharge when the ratio of the steel to the slag in the total flow is relatively low. Of course, the inclusion of slag in the molten steel is undesirable for the reasons discussed in detail above.

Further, it would be desirable to provide an improved slag control system for controlling a discharge of molten metal and slag from a furnace wherein an apparatus for receiving the molten metal and slag is completely detached from the furnace and can be controlled and tilted on its own.

It also would be desirable to provide an improved slag control system for controlling a free-falling discharge of molten metal and slag from a rotating furnace having an apparatus for receiving the molten metal and slag directly from the rotating furnace and which can accommodate movement of the flow impact position of molten metal and slag which occurs from rotation of the furnace during draining of the furnace.

Further, it would be desirable to provide such an improved slag control system, usable with or without a trough from the furnace, which significantly reduces turbulence of the free-falling flow of molten metal and slag, particularly if no trough is utilized, and which is small enough to be positioned and pass under a rotating furnace yet large enough to handle a substantial amount of material at one time.

It also would be desirable to provide an improved slag control system for controlling a discharge of molten metal and slag from a furnace which includes an apparatus for receiving the molten metal and slag that is completely detached from the furnace and which not only can be tilted, but readily can be moved independently in both a vertical direction, a horizontal direction or a combination of both vertical and horizontal directions. Such an apparatus is particularly useful in moving the apparatus to enable any residual molten metal and slag to be completely removed therefrom.

The present invention improvements are directed to minimizing the above-described problems, and the invention provides a number of operating improvements.

SUMMARY OF THE INVENTION

This invention provides an apparatus and method for controlling slag in a tap discharge of molten metal and slag from a tap hole of a tilting furnace which is variably tiltable between an upright, non-tilted position and a fully-tilted position.

One form of the apparatus of the present invention includes a device that can be mounted on a trough that normally extends outwardly from the furnace tap hole and which defines a flow channel for the molten metal and slag. The device defines an inlet for receiving molten metal and slag from the trough flow channel and has an outlet from which the molten metal can be discharged.

The device defines a reservoir communicating with the trough flow channel at the device inlet and defines a slag opening from which the slag can be discharged.

The device further defines a bottom opening to the reservoir below the level of the slag opening and defines a passage communicating between the bottom opening and the outlet. The passage also defines a weir which extends generally upwardly above the level of the bottom of the slag opening and over which the molten metal flows to the outlet. In a preferred form, the passage is laterally offset from the reservoir. The slag opening is located at least as far outwardly as is the weir, and the slag opening is located further outwardly than the weir.

In an alternative aspect of the invention, a tilting vessel separates molten metal from slag. The vessel has a lateral opening for discharge of slag, a dam portion, an opening in the bottom of the dam portion, a passage extending from the dam opening to a weir, and a discharge opening in the front of the vessel.

In another embodiment of the vessel, a reservoir for receiving molten metal and slag is defined in part by an intermediate wall. The lateral opening is defined in a side wall of the reservoir. The intermediate wall defines in part a dam portion and a dam opening at the bottom of the dam portion. A passage from the dam opening to the weir is laterally offset from the reservoir. The passage extends rearwardly and upwardly from the dam opening to the top of the weir. The tilt control mechanism includes a pair of hydraulic cylinders located at the front and back of the vessel for lifting and tilting the vessel.

According to another aspect of the invention, a method is provided for controlling the slag in the tap discharge of molten metal and floating slag from a tap hole of a tilting furnace which is variably tiltable between an upright, non-tilted position and a fully-tilted position and wherein the furnace has a trough for extending outwardly from the tap hole for directing the flow of the molten metal and slag from the furnace to a discharge outlet. In an alternative aspect of the method, the molten metal and slag are received and then controlled and separated in a tilting vessel.

In this method, the furnace and trough means are sufficiently tilted to discharge the molten metal and slag from the tap hole into the trough means. The molten metal can flow under the influence of gravity out of the discharge outlet during the subsequent process steps. Alternatively, the molten metal and slag are received by the tilting vessel and the vessel is tilted so that the molten metal can flow under the influence of gravity out of the discharge outlet during the subsequent process steps.

In particular, the flow of molten metal is directed sequentially into a reservoir from which the slag can be discharged, into a passage from a bottom opening in the reservoir, then generally upwardly along a weir that is partly defined by the passage, and finally over the top of the weir to the outlet. The slag is retained by the reservoir while permitting the molten metal to flow out of the outlet. The retained slag is discharged through a slag opening defined by the reservoir while maintaining the slag opening at least as far outwardly as the weir and at a level above the level of the bottom opening.

According to a further aspect of the method, the flow of molten metal is directed sequentially into a reservoir, into a laterally offset passage from a bottom opening in the reservoir, then generally upwardly along a weir that is partly defined by the passage, and then over the top of the weir to the outlet. While the molten metal flows out of the outlet, the slag is retained in the reservoir and discharged from the reservoir through the slag opening.

According to another aspect of the invention method, the molten metal is directed into a reservoir from which the slag can be discharged, into a passage from a bottom opening in the reservoir, then generally rearwardly and then upwardly along a weir that is partly defined by the passage, and then over the top of the weir to the outlet. As the molten metal flows out of the outlet, the slag is retained in the reservoir and discharged from the reservoir through the slag opening.

According to yet another aspect of the invention, a vessel is provided for separating molten metal from slag which not only is tiltable but can be moved in both a horizontal direction, a vertical direction, or both. The vessel has a reservoir, an opening for discharge of slag, a dam portion, an opening in the bottom of the dam portion, a passage extending from the dam opening to a weir and a molten metal discharge opening in communication with the weir.

In one embodiment of the vessel, the reservoir includes a predetermined molten metal and slag flow path which is defined in part by an intermediate wall that substantially divides the reservoir into a first flow receiving inlet portion or chamber and a second outlet portion or chamber. The slag discharge opening is provided in a rear wall of the vessel adjacent the first and second chambers and the molten metal discharge opening is provided in a front wall of the vessel within the passage. The dam defines the end of the second outlet portion of the reservoir flow path and extends between the intermediate wall and a side wall of the vessel. The passage from the dam opening to the weir is positioned substantially in-line with the second outlet portion of the reservoir flow path. The mechanism for tilting and moving the vessel includes a tilting table connected to the vessel and a moving table connected to the tilting table, each table being controlled by a respective pair of hydraulic cylinders. The moving table is in operable communication with a guiding and locking mechanism for proper positioning and stabilizing of the vessel as desired.

According to another aspect of the invention, a method is provided for controlling the slag in a free-flowing tap discharge of molten metal and slag from a tap hole of a rotating furnace which is variably rotatable between an upright, non-rotated position and a fully rotated position. In this method, the furnace is sufficiently tilted to discharge the molten metal and slag from the tap hole of the furnace into a vessel located directly below. The vessel is both tiltable and movable and it controls, stabilizes and separates the molten metal and slag. The vessel initially is moved to a first position so that turbulence of the molten metal and slag within the vessel created by the free-falling flow is stabilized and the slag can rise and float on top of the molten metal. Thus, molten metal can flow out of a molten metal discharge outlet in the vessel while the slag is separated from the molten metal and retained within the vessel. Upon accumulation of a sufficient amount of slag within the vessel, the slag initially can be discharged out of a slag outlet. As the quantity of slag exiting the furnace increases, the vessel can be tilted to a second position which increases the rate of discharge of slag out of the vessel while maintaining the discharge of molten metal.

In particular, the free-falling flow of molten metal and slag initially is directed into a reservoir from which the slag can be separated from the molten metal and discharged. Both the slag and molten metal proceed along a predetermined flow path within the reservoir with the much heavier molten metal sinking to the bottom of the reservoir and flowing into a passage defined by a bottom opening in a dam positioned at the end of the reservoir flow path. The molten metal flows through the passage, generally upwardly along a weir partly defined by the passage, and finally over the top of the weir to the molten metal outlet. The slag floats on top of the molten metal and is retained within the reservoir by the dam while the molten metal flows under the dam and out of the molten metal outlet. As the level of retained slag rises, it reaches the slag outlet where it can begin to discharge out of the slag opening. To increase the flow of slag out of the slag opening as the quantity of slag entering the vessel from the furnace increases, the vessel can be tilted to a desired position while maintaining a flow of molten metal out of the molten metal outlet.

Further, the invention includes positioning the molten metal and slag separator vessel with respect to a container or ladle to enable any residual molten steel and slag to be removed from the vessel.

The novel apparatus and method of the present invention can be readily employed with electric arc furnaces, rotating furnace or any other desired furnace and accommodate a relatively high flow rate. The use of the method and apparatus of the present invention does not increase the tap discharge time to an extent that would cause an undesirable amount of heat absorption in the apparatus and that would cause an undesirably high temperature drop in the molten metal.

The present invention accommodates designs that can better withstand the damaging effects of heat, erosion, and wear.

Further, the system of the present invention can reduce, if not substantially eliminate, flow irregularities and can reduce the likelihood of entraining large amounts of slag in the steel during the tap discharge.

Other features and advantages of the present invention will become readily apparent from the following detailed description, accompanying drawings, and appended claims.

BRIEF DESCRIPTION OF THE DRAWINGS

The invention is described in greater detail in the following description of the preferred embodiment, taken in conjunction with the drawings, in which.

DETAILED DESCRIPTION OF THE PREFERRED EMBODIMENT

Figure 1:
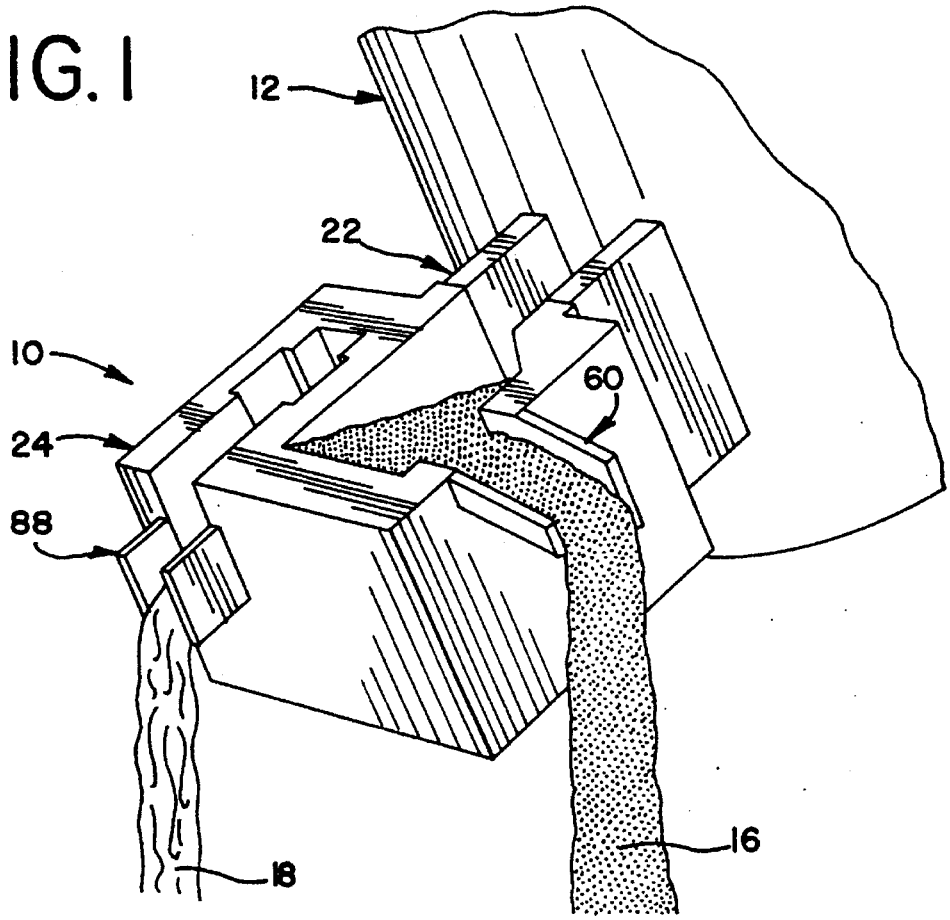
FIG. 1 is a simplified, fragmentary, perspective view of an embodiment of the slag control apparatus of the present invention shown mounted on a tilted electric furnace to discharge separate flows of molten steel and slag.

While the present invention may be embodied in various forms, certain preferred embodiments are shown in the drawings and are described below. However, the description of preferred embodiments is not intended to limit the scope of the invention to the disclosed embodiments. The principles of the invention may be embodied in various other forms which are not described herein.

For ease of description, the apparatus of this invention is described in the normal operating positions, and terms such as upper, lower, horizontal, etc., are used with reference to these positions. It will be understood, however, that the apparatus of this invention may be manufactured, stored, transported, and sold in an orientation other than the positions described.

Some of the figures illustrating the preferred embodiments show structural details and mechanical elements that will be recognized by one skilled in the art. However, the detailed descriptions of such elements are not necessary to an understanding of the invention, and accordingly, are not herein presented.

The present invention provides a novel system for efficiently controlling or separating slag in a tap discharge of molten metal. The system accommodates a relatively high flow rate to minimize the adverse effects of heat absorption by system components and temperature drop of the flowing molten metal and slag.

One form of the apparatus of the present invention is illustrated in a simplified manner in FIG. 1 wherein the apparatus is designated generally by the reference numeral 10 and is shown mounted to the side of a conventional, tilting, electric furnace 12.

Figure 2:
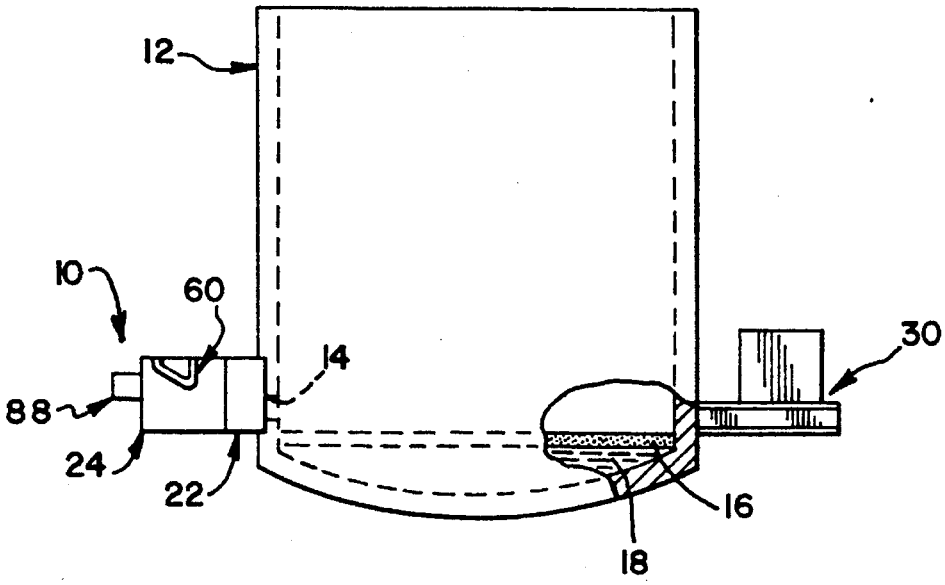
FIG. 2 is a simplified, fragmentary, elevation view of the slag control apparatus and the tilting furnace with the furnace in the normal vertical position and with a portion of the furnace wall cut away to illustrate interior detail.

The furnace 12 is tiltable between a non-discharging, vertical, upright position which is generally illustrated in a greatly simplified manner in FIG. 2 and a final, fully tilted, discharging position which is illustrated in FIG. 1. In the fully tilted position, a typical conventional furnace 12 is tilted between about 36° and about 41° from the vertical.

As illustrated in FIG. 2, the furnace 12 includes a tap hole 14 through which is discharged the molten metal and slag. Typically, the furnace 12 is heated and the metal contained therein is melted. In a fully charged, conventional electric furnace, a floating slag layer 16 forms on top of the melted or molten metal 18. The molten metal 18 lies below the tap hole 14, and the slag layer 16 may extend up to the tap hole 14 or somewhat above the tap hole 14.

Some conventional, tilting, electric, furnaces are provided with an outwardly and upwardly extending trough (not illustrated), and in many cases, the trough is angled upwardly about 15° from the horizontal when the furnace is in the vertical position. The trough is mounted to the furnace at the tap hole and defines a flow channel for directing the molten metal and slag from the furnace tap hole when the furnace is tilted.

Figure 3:
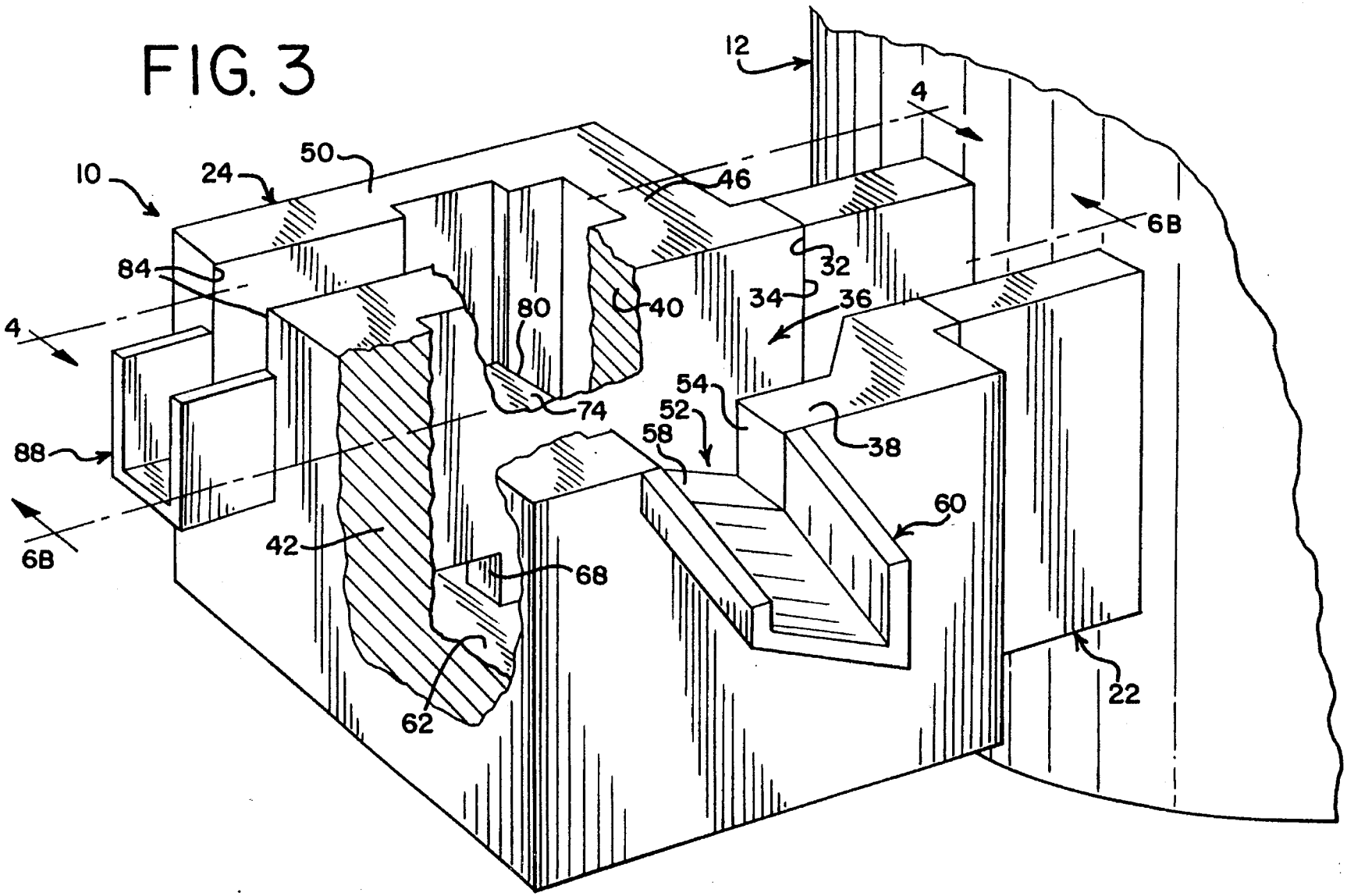
FIG. 3 is a greatly enlarged view similar to FIG. 1, but with the furnace in the normal vertical position prior to a tap discharge.

In the preferred form of the present invention, a vessel in the form of a trough 22 is provided on the furnace 12 at the tap hole 14 so as to extend generally horizontally when the furnace is in the vertical position (FIG. 2). The trough 22 has a slag separating device 24 at its distal end and defines a generally U-shaped, upwardly open, flow channel for directing the molten metal 18 and slag 16 to the device 24 as can be seen in FIG. 3.

The trough 22 and device 24 are preferably fabricated with suitable steel plated shell members and structural support members (not illustrated), and the shell members are lined with refractory material. The refractory material may be a special or conventional case refractory material or refractory brick. The composition of the refractory material can vary depending upon the temperature requirements.

For a typical tilting furnace, the length of the trough 22 would be between about 3 feet and about 5 feet, and the device 24 would project outwardly from the distal end of the trough 22 by an additional amount in the range of between about 5 feet and about 8 feet. The height of the device 24, in the vertical direction parallel to the height of the furnace 12, may lie in the range of about 5 feet to about 9 feet, and the height of the trough 22 could be the same or less. The width of the device 24, perpendicular to the length of the trough 22, could range between about 5 feet and about 9 feet. Of course, depending upon the particular size of the furnace 12, and perhaps on other conditions, the size of the components could be larger or smaller than those described above.

In the preferred form of the invention, the steel plates are provided to form an exterior shell for the trough 22 and device 24. The shell portions can be lined with refractory paper, such as that sold under the trademark FIBERFRAX. The refractory material, such as refractory brick, is placed on this within the steel shell portions.

In view of the large size and associated great weight of the trough 22 and device 24, it may in some situations be necessary, or desirable, to provide a counterweight structure 30 on the furnace 12 at a location 180° from the tap hole 14 as illustrated in FIG. 2. The structural support for, and design of, the counterweight, as well as the structural support for, and design of, the structural members for supporting the trough 22 and device 24, depend upon the design of the particular furnace and clearances around the furnace at the furnace site. Such structural support systems and counterweight systems can be designed according to conventional structural engineering principles, and such designs are no part of the present invention.

Figure 4:
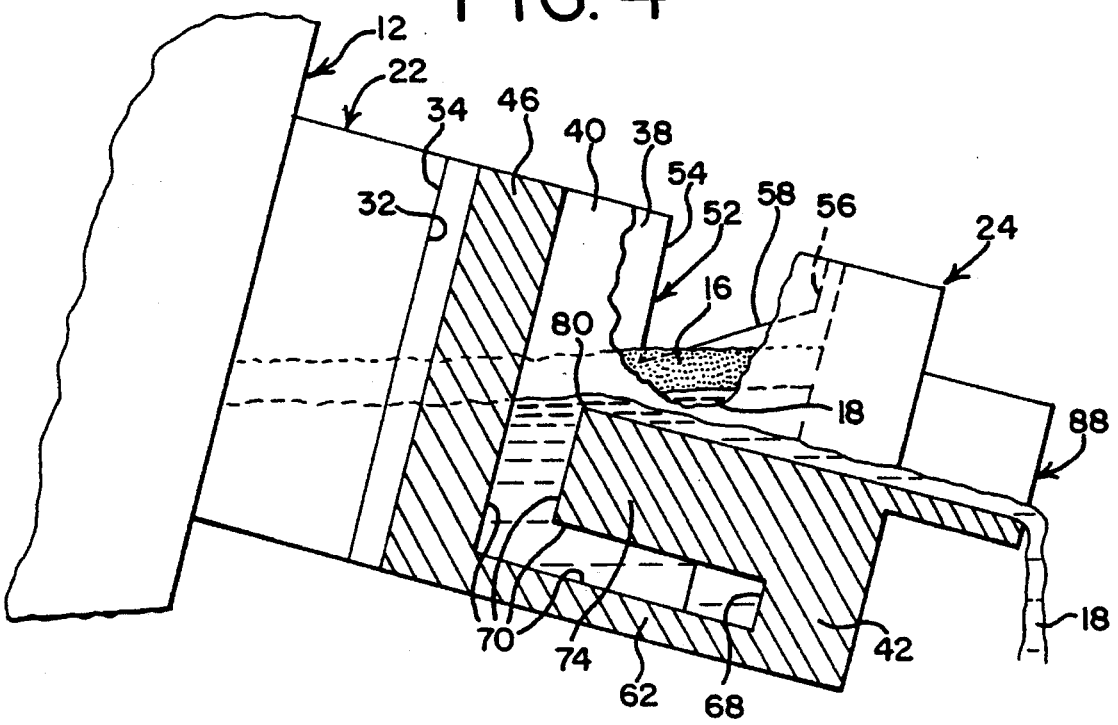
FIG. 4 is a fragmentary, cross-sectional view taken generally along the plane 4—4 in FIG. 3, with certain portions cut away to illustrate interior detail, of a portion of the slag control apparatus with the furnace having been tilted about 15° from the normal upright position shown in FIG. 3 and held in that position for a few seconds after the molten metal and slag have begun discharging from the furnace.
Figure 5:
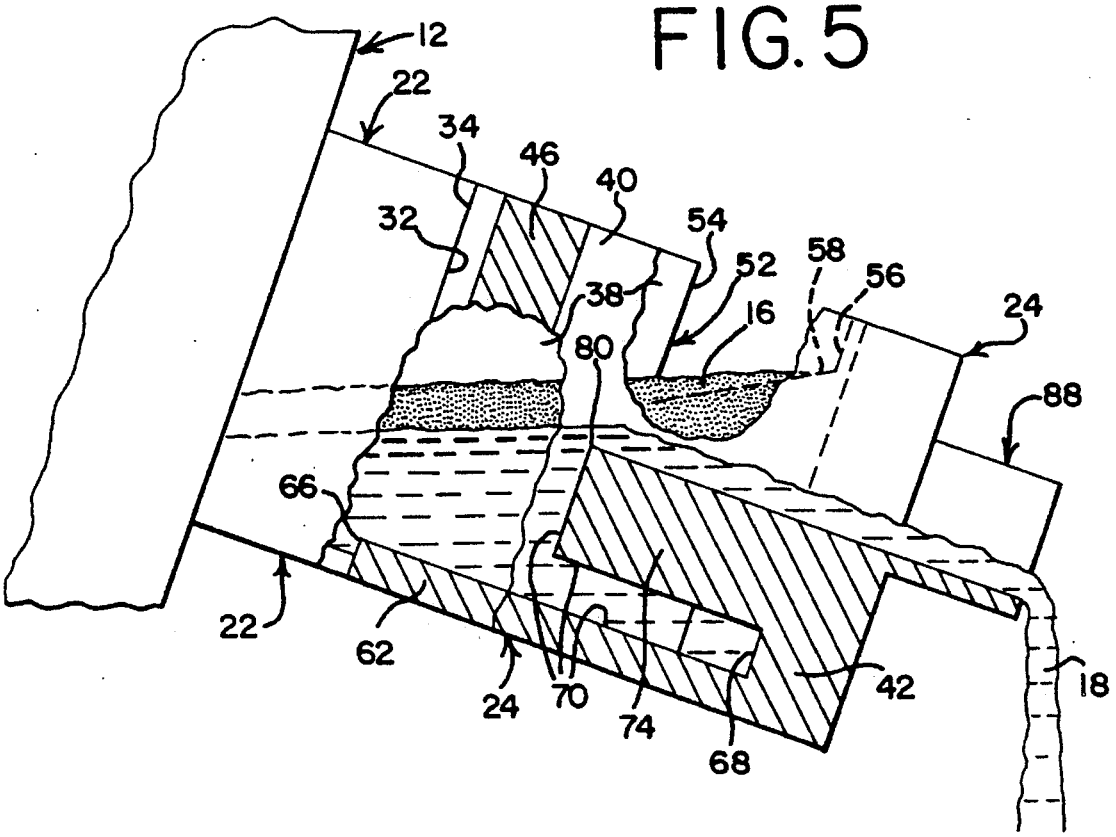
FIG. 5 is a view similar to FIG. 4 with certain portions cut away to illustrate interior detail, but showing the apparatus just after the furnace has been further tilted to about 20° from the upright position.

With reference to FIGS. 3 and 4, the trough 22 can be characterized as having a distal end 32, and the device 24 can be characterized as having an inlet end 34 which is mounted to the trough distal end 32. The device 24 defines a reservoir 36 in communication with the flow channel of the trough 22 at the device inlet end 34.

The reservoir 36 is defined on one side by a side wall 38 and on the other side by an intermediate wall 40. On the side of the device 24, spaced from the intermediate wall 38, is another side wall 50. The device 24 includes a front wall 42 which defines the front of the reservoir 36 and extends between the side walls 38 and 50. Further, the device 24 has a rear wall 46 extending across the back end of the device 24 except where the reservoir 36 is open to the interior of the trough 22.

In the upper portion of the reservoir 36, the side wall 38 defines a slag opening or notch 52 from which the slag 16 can be discharged in a manner described in detail hereinafter. The slag opening 52 includes a vertical, rear or inner surface or wall 54 and a vertical, front or outer surface or wall 56 (FIG. 4). The vertical walls 54 and 56 are joined by a bottom wall 58 which is angled, in a preferred embodiment, at about 30° relative to the horizontal (i.e., relative to a horizontal line that is perpendicular to the vertical axis of the furnace when the furnace is in the vertical, upright position).

In one embodiment, the slag opening 52 is a notch which is cut out from the top of the side wall 38. However, the other suitable openings in the side wall 38 may be used.

A slag chute 60 is mounted to the device side wall 38 and extends laterally outwardly from the slag opening 52 for discharging the slag 16 to a preselected deposit region. Chute 60 is preferably fabricated from suitable steel support plates to form a shell in which refractory materials, such as refractory bricks, are placed to form a lined discharge trough.

The chute 60 may have any suitable configuration appropriate for the particular furnace installation. In the illustrated embodiment, the chute 60 slopes somewhat downwardly from the slag opening 52 and has a cross-sectional configuration generally corresponding to the configuration of the slag opening 52. It will be appreciated, however, that the configuration of the chute 60 need not necessarily match the configuration of the slag opening 52.

Figure 6A:
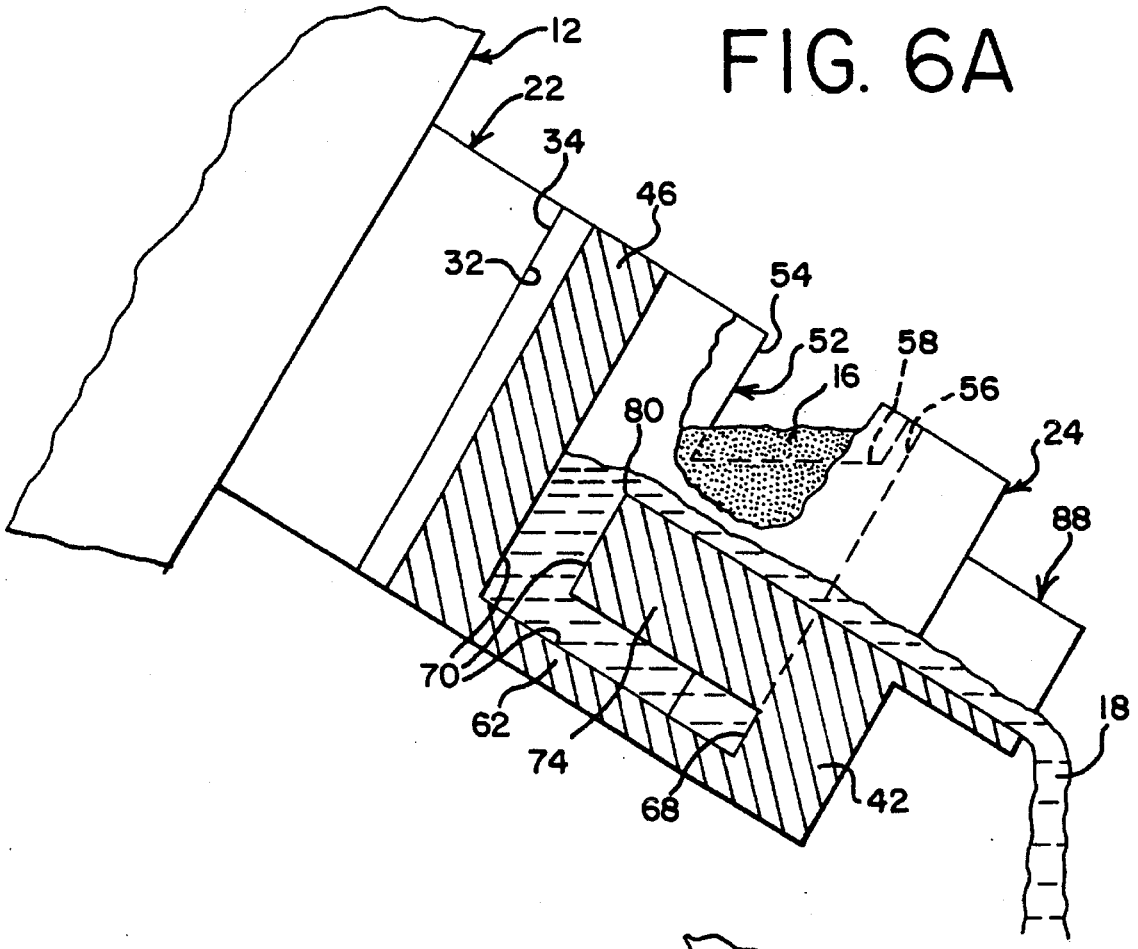
FIG. 6A is a view similar to FIG. 5 with certain portions cut away to illustrate interior detail, but showing the apparatus after the furnace has been tilted to about 30°.
Figure 6B:
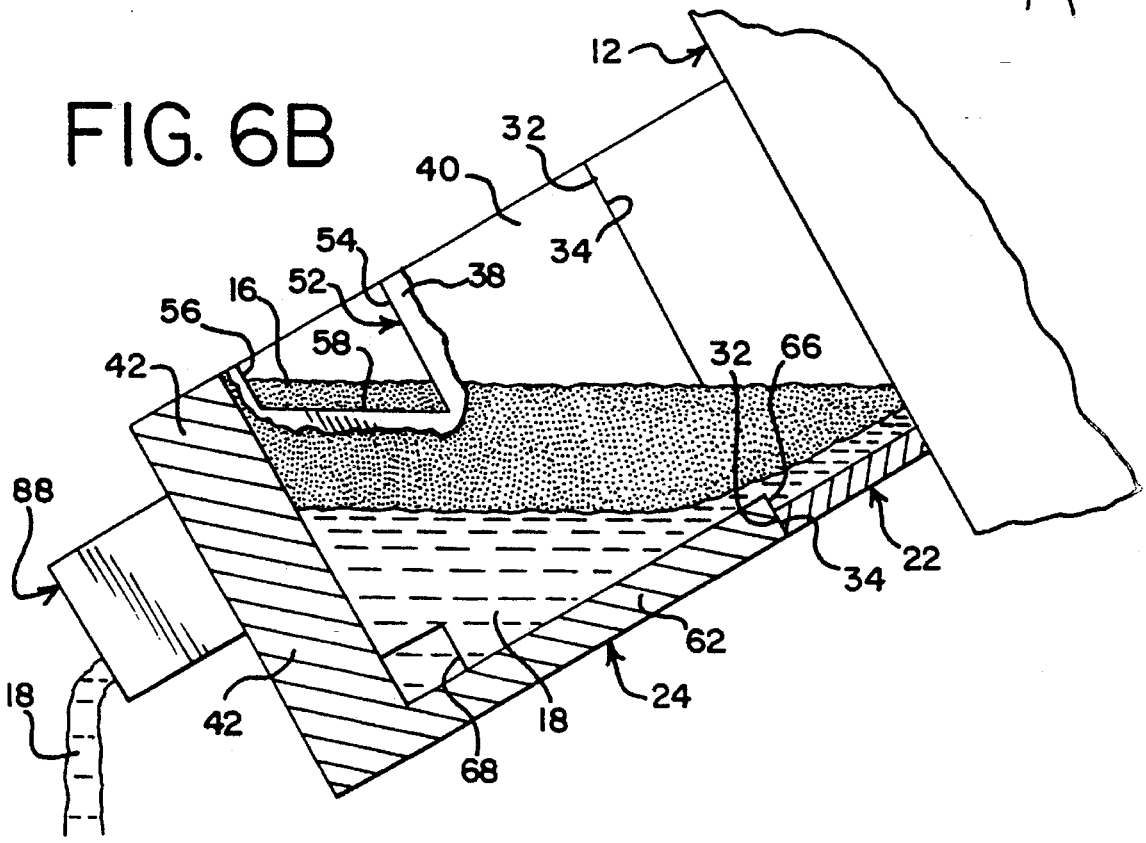
FIG. 6B is a fragmentary, cross-sectional view, taken generally along the plane 6B—6B in FIG. 3, of a portion of the slag control apparatus with the furnace having been tilted about 30° from the normal upright position shown in FIG. 3, and FIG. 6B thus corresponds to FIG. 6A with respect to the tilt angle and flow conditions, it being realized that a portion of the apparatus side wall and a slag opening are shown in FIG. 6B in elevation superimposed upon the cross-section.

The bottom of the device 24 is defined by a bottom wall or floor 62. As best illustrated in FIG. 6B, the surface of the floor 62 is higher than the surface of the bottom of the trough 22 so that a vertical wall 66 is defined by a step at the junction between the distal end of the trough 22 and the device inlet end 34. In a presently contemplated embodiment, the height of the vertical wall 66 of the step is about 3 inches and results from the use of two layers of a conventional refractory brick in the bottom of the trough 22 and three layers of refractory brick to form the device bottom wall 62. The conventional refractory brick is 3 inches high, and the extra layer of brick in the device bottom wall 62 results in the upper surface of the bottom wall 62 being 3 inches higher than the surface of the bottom of the trough 22.

The vertical wall 66 formed by the device bottom wall 62 defines a barrier or dam. When the furnace 12 is in the normal upright position, the wall 66 is vertical. The wall 66 will function as a dam if the furnace tap hole 14 (FIG. 2) is inadvertently opened when the furnace is in the upright position. To the extent that the floating slag 16 in the furnace may be at, or extend above, the tap hole 14, some slag could flow out of the inadvertently opened tap hole into the horizontal trough 22. The vertical wall 66 would serve to prevent all or most of the inadvertently discharged slag 16 from entering the device 25 until the furnace is ready to be tapped and the furnace is tilted to discharge the slag and molten metal.

The intermediate wall 40 defines a bottom opening 68 (FIGS. 3 AND 4) which is in communication with the reservoir 36. The bottom opening 68 is preferably located at the bottom of the intermediate wall 40 at the forward end of the floor 62 so that the top surface of the floor 62 defines the bottom of the opening 68. However, the opening 68 could be located somewhat higher up and/or somewhat rearwardly in the wall 40. The opening 68 could also be provided as a tunnel or passage in or through the floor 62 or front wall 42 so as to extend from the reservoir 36 under or around the intermediate wall 40 to the other side of the intermediate wall 40.

As best illustrated in FIG. 4, the device 24 defines a passage 70 on the side of the intermediate wall 40 facing away from the reservoir 36. This passage 70 may thus be characterized as being laterally adjacent, or offset from, the reservoir 36.

The passage 70 communicates at one end with the opening 68 and has a horizontal, first portion that preferably extends along the top of the floor 62 rearwardly toward the device back wall 46. The top of the horizontal portion of the passage 70 is defined by an intermediate shelf portion 74 which extends rearwardly from the device front wall 42. The passage 70 includes an upwardly extending portion between the rear end of the shelf portion 74 and the back wall 46. The rear, distal end of the shelf portion 74 functions as a weir and serves to define a part of the vertical portion of the passage 70. In this preferred configuration, the bottom opening 68 is located further outwardly from the furnace than the weir.

As best illustrated in FIG. 4, the intermediate shelf portion 74 defines a rear, top edge 80 which functions as the top of the weir and may be characterized as a flow point or flow line over which the molten metal 18 can flow when the furnace 12 is tilted during the tap discharge.

The top of the intermediate shelf portion 74, in conjunction with the side wall 50 and intermediate wall 40, define a flow channel which extends to an outlet or discharge opening 84 (FIG. 3) in the device front wall. Preferably, a small trough 88 is mounted to the device front wall 42 at the discharge opening 84 to assist in directing the molten metal into a ladle (not illustrated).

It will be appreciated that the passage 70 is laterally offset relative to the reservoir 36. This novel arrangement permits, among other things, the slag opening 52 to be located relatively close to the device front wall 42. Indeed, with reference to FIG. 4, the slag opening 52 is located further outwardly than is the weir top flow edge 80.

Figure 7:
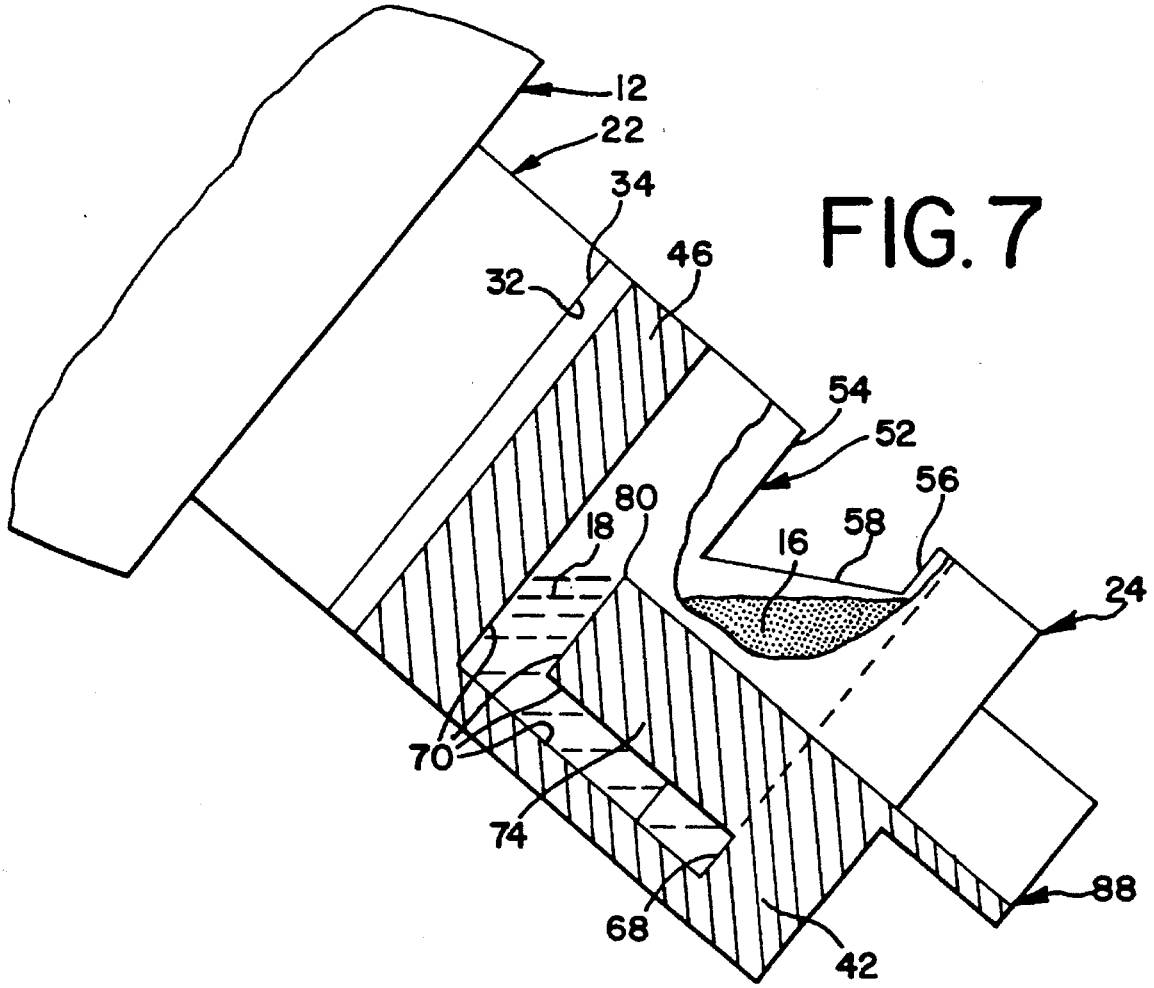
FIG. 7 is a view similar to FIG. 6A with certain portions cut away to illustrate interior detail, but showing the apparatus after the furnace has been tilted to about 40° from the upright orientation and held in that position until the end of the tap.

The slag opening has a configuration such that the lowest part of the opening 52 is located at a level which is a predetermined distance above the level of the weir top edge 80. Further, the slag opening bottom wall 58 is oriented at an angle having the following relationships with respect to the other parts of the system:

1. When the furnace 12 is in the vertical, upright position (FIG. 2) or tilted only a small amount (FIG. 4), the slag opening bottom wall 58 slopes upwardly toward the device front wall 42 so that the low point of the slag opening is defined at the intersection of the bottom wall 58 and the rear vertical wall 54; and
2. When the furnace is fully tilted (at the end of the tap discharge), then the slag opening bottom wall 58 slopes downwardly in the direction away from the furnace 12 so that the low point of the slag opening 52 is then defined at the intersection of the slag opening bottom wall 58 and slag opening vertical front wall 56 (FIG. 7).

In one embodiment, the device floor 62 is about 9 inches thick, the side wall 38 is about 13½ inches thick, the intermediate wall 40 is about 18 inches thick, the side wall 50 is about 13½ inches thick, the front wall 42 is about 13½ inches thick, and the rear wall 46 is about 13½ inches thick. The reservoir 36 is about 22½ inches wide between the walls and 40, about 60 inches deep, and about 72 inches long between the trough end 32 and front wall 42.

The bottom opening 68 is rectangular in cross-section, having about a 15 inch height and about a 9 inch width.

The horizontal portion of the passage 70 is 9 inches high and 18 inches wide, and extends about 57½ inches from the rear edge of the bottom opening 68 to the inside surface of the back wall 46. The vertical, upwardly extending portion of the passage 70, between the distal end of the intermediate shelf portion 74 and the rear wall 46, has a depth of about 27 inches as measured from the floor 62 to the intermediate shelf weir top edge 80. The width of the passage 70, between the intermediate wall 42 and the side wall 50, is about 8 inches, and the length of the passage 70 between the back wall 46 and the intermediate shelf portion 74 is about 12 inches.

The depth or thickness of the intermediate shelf portion 74, from the top horizontal surface of the shelf to the lower horizontal surface of the shelf, is about 18 inches at the rear distal end (adjacent the vertical portion of the passage 70). In a contemplated embodiment, the upper surface of the intermediate shelf 70 may have a small slope (e.g., 4°) from a high point at the weir upper edge 80 to a low point at the device front wall discharge opening 84.

The vertical rear wall 54 of the slag opening 52 is about 23 inches deep, the vertical front wall 56 is about 4 inches deep, and the bottom wall 58 extends between the two walls at an angle of about 30° relative to the normal, horizontal orientation of the device 24.

When the device 24 is in the horizontal orientation (FIG. 3) wherein the furnace 12 is in the vertical, upright position, the low point of the slag opening 52 (at the intersection of the slag opening vertical, rear wall 54 and the slag opening bottom wall 58) is at an elevation of about 12 inches above the intermediate shelf weir top edge 80. Thus, when the furnace is tilted to a conventional full tilt position (e.g., about 40°), the front corner of the slag opening 52 (defined by the intersection of the slag opening vertical, front wall 56 and the slag opening bottom wall 58) would be at an elevation about 9 inches higher than the level of the intermediate shelf weir top edge 80.

Although the device 24 is illustrated as being substantially open, a cover (not illustrated) could be placed over portions of the device 24, and a housing (not illustrated) could be placed around peripheral and bottom portions of the device 24. Such covers and housings, or portions thereof, should, of course, be removable to afford access to the device 24. Such access, at least for viewing purposes, may be desirable with respect to portions of the device 24 during operation. Further, access to the interior of the device 24 may be necessary for maintenance, as well as for repair and/or replacement of the refractory material from time to time.

In operation, the furnace 12 is ready to be tilted after the metal has been melted and heated to the desired temperature. The furnace 12 is then tilted, and the tap hole 14 is necessarily carried downwardly by the furnace wall until the tap hole 14 is well below the level of the floating slag 16.

The molten metal 18 flows through the tap hole 14 while the floating slag 16 remains inside the furnace 12. As the molten metal 18 drains from the furnace 12, the operator increases the tilt of the furnace 12 in order to keep the floating slag 16 above the level of the tap hole 14.

When the molten metal 18 initially flows into the trough 22, it will begin to fill and flow through the device 24. The molten metal 18 flows from the reservoir 36 through the bottom opening 68 into the passage 70. Thus, the intermediate wall 40 functions as a dam that retains molten metal 18 and slag 16 in the reservoir 36 while permitting molten metal 18 in the bottom of the reservoir 36 to pass through the bottom or dam opening 68 and into the passage 70. The molten metal 18 then flows rearwardly through the horizontal portion of the passage 70 and upwardly through the vertical portion of the passage 70.

As the furnace is being increasingly tilted, the molten metal 18 spills over the weir top edge 80 on the intermediate shelf 74, flows along the top of the shelf 74 to the discharge opening 84, and discharges through a small trough 88.

As discussed above, the molten metal 18 flowing through the tap hole 14 may tend to vortex. The vortexing of the molten metal 18 will draw interface slag from the floating furnace slag 16 down into the tap hole 14 where the interface slag will flow with the molten metal 18 through the tap hole 14 and trough 22 to the reservoir 36.

Although vortexing occurs as the molten metal 18 flows through the tap hole 14, little or no vortexing occurs as molten metal 18 flows through the dam opening 68.

The interface slag that is drawn into the trough 22 separates from the molten metal 18 and rises to the surface to form the layer of floating slag 16 in the trough 22 along with any other surface slag that may have been inadvertently discharged from the furnace 12.

During the tap, when the molten metal 18 is flowing in the trough 22, the operator may view the trough 22 from an elevated vantage point which allows him to see into the slag chute 60 and trough 22. He can adjust the tilt of the furnace 12 to control the rate at which the molten metal 18 and slag 16 are flowing through the tap hole 14 and into the trough 22 and thereby control the level of molten metal 18 and slag 16 in the reservoir 36 during the tap. If the depth of molten metal 18 and slag 16 in the reservoir 36 becomes too great, then the operator can slow down, or temporarily stop or reverse, the tilting of the furnace 12.

As the molten metal 18 is drained from furnace 12, the operator gradually increases the tilt of the furnace 12 to maintain the depth of molten metal 18 and slag 16 in the reservoir 36. As can be seen in FIGS. 4–7, when the molten metal is being discharged from the trough 22, the level of molten metal 18 in the reservoir 36 is always kept below the bottom wall 58 of the slag opening 52, while some thickness of the layer of floating slag 16 is kept above the bottom wall 58 of the slag opening 52. Thus, the molten metal 18 does not flow through the slag opening 52, but floating slag 16 does flow through the slag opening 52 into the slag chute 60 as shown in FIGS. 1, 4, 5, 6A and 6B.

As the amount of floating slag 16 in the device 24 increases, the thickness of the layer of floating slag 16 will increase. FIGS. 4–7 show this increase in the depth of floating slag 16. The thick layer of floating slag 16 in the reservoir 36 can somewhat depress the level of the molten metal 18 in the reservoir 36 compared to the level of the molten metal 18 flowing over the weir edge 80.

After the molten metal 18 has substantially drained from the furnace 12, most of the remaining floating slag 16 in the furnace 12 will continue to flow through the tap hole 14 and into the trough 22 and device 24. This will usually begin to occur when the furnace 12 is tilted to between about 35° and about 38° from vertical—in a conventional electric arc furnace which tilts from 0° to approximately 45° from vertical. As the furnace 12 continues to tilt to its fully-tilted position, this flow of slag 16 through the tap hole 14 will cause the amount of slag 16 in the device 24 to greatly increase. This flow of slag 16 through the furnace tap hole 14 will be evident to the operator, who will see an increase in the amount of floating slag 16 in the trough 22 and in the reservoir 36 of the device 24.

After substantially all of the molten metal 18 has been drained from the furnace 12 into the trough 22 and device 24, the molten metal 18 in the device 24 will stop flowing over the weir edge 80 at the top of the passage 70 and will remain at the level of the top edge 80 as shown in FIG. 7. After this occurs, and after the slag 16 has been discharged from the reservoir 36 through the slag opening 52 down to the level of the opening bottom wall 58, the operator stops any further tilting of the furnace 12 and returns the furnace 12 to the upright position.

The density of the slag 16 is much less than that of the molten metal 18, and the level of slag in the reservoir 36 is not sufficient to overcome the static head of the molten metal 18 in the horizontal and vertical portions of the passage 70. The slag 16 in the reservoir 36 does not lower the level of the molten steel 18 in the reservoir 36 so far as to allow the slag 16 to flow through the dam opening 68 and into the passage 70. Thus, the slag 16 does not flow through the device 24 and out of the discharge opening trough 88.

As the operator returns the furnace 12 to the upright position, most of the remaining molten metal 18 and slag 16 in the device 24 will flow back along the trough 22 to the furnace 12. If desired, a drain system (not illustrated) may be provided in the bottom of the device 24 to assist in emptying the device. This could include a normally plugged drain hole, or slight slopes in the floor portions of the passage 70 and/or reservoir 38 for facilitating a flow out of the device 24 and into the trough 22 when the furnace is upright.

It has been found that the novel design of the reservoir 36, in conjunction with the laterally offset passage 70, can be operated in a manner that substantially eliminates, or at least greatly minimizes, flow irregularities that might otherwise exist. The reservoir 36 provides a sufficient static head to effect a flow of the molten metal 18 out of the device 24 while accommodating an increasingly thick layer of floating slag 16 in the reservoir 36. This novel arrangement reduces the probability that slag 16 will be entrained or drawn into the molten metal flow through the dam opening 68 to the passage 70. This is especially important near the end of the tap discharge process when the ratio of molten metal 18 to the slag 16 in the flow from the tap hole has significantly decreased.

With reference to FIG. 4, it will be appreciated that when the furnace 12 is partially tilted (e.g., about 15°), the slag 16 initially flows through the slag opening 52 at the low point of the opening 52 which is then defined at the intersection of the slag opening vertical, rear wall 54 and the slag opening bottom wall 58. However, as the furnace tilt angle increases, the forward end of the slag opening bottom wall 58 drops to an elevation which is at the same elevation as the rear end of the slag opening bottom wall. For the illustrated design, this occurs when the furnace has been tilted about 30° from vertical as illustrated in FIGS. 6A and 6B. Finally, as the furnace is tilted further, the forward end of the slag opening bottom wall 58 drops to a level below that of the bottom wall rear end (e.g., FIG. 7).

In this way, the shape of the slag opening 52 can accommodate the discharge of the slag layer 16 through increasing angles of tilt. The normally, upwardly angled bottom wall 58 of the slag opening prevents the low point of the slag opening from dropping too far with an increasing tilt angle near the end of the tap discharge process.

It will also be appreciated that the slag opening 52, in the preferred embodiment illustrated, is located outwardly beyond the intermediate shelf weir top edge 80 over which the molten metal 18 flows. This novel arrangement results in a decreasing distance between the elevation of the bottom of the slag opening 52 and the weir top edge 80 as the furnace tilt angle increases. This configuration operates to reduce the thickness of the layer of floating slag 16 in the reservoir 36 during the tap discharge process.

The novel apparatus of the invention can readily accommodate design features which serve to provide a rugged apparatus that is less susceptible to wear and degradation from flowing metal and high temperatures. For example, the intermediate shelf portion 74 can have a relatively great thickness, such as 18 inches in the contemplated embodiment described herein. This invention thus does not require the use of relatively thin structures adjacent, or defining, flow passages. The absence of thin structures from embodiments of the apparatus of the present invention can result in a longer operating life for the apparatus and/or portions thereof.

The apparatus of the present invention can be embodied in designs that will accommodate relatively high flow rates which may equal, or significantly approach, the flow rates exhibited by a conventional open-ended discharge trough. Thus, the additional time required for a tap discharge with the present invention can be kept to a minimum so as to avoid excessive temperature drops in the molten metal and so as to avoid excessive heat build up in the apparatus.

Although not illustrated, the device 24 could be mounted as illustrated to the end of a trough on a conventional furnace. However, in one embodiment of the present invention, the device 24 is mounted as illustrated to the end of a trough 22 which is oriented substantially horizontally with respect to the normal, vertical, upright position of the furnace 12.

With this arrangement, the furnace 12 does not have to be tilted at the beginning of the pour compared to furnaces which incorporate a trough that is angled slightly upwardly. That is, the invention device 24, when mounted on the end of the horizontal trough 22, swings downwardly with the tilting of the furnace 12 so that the weir top edge 80 is initially at a relatively low elevation to accommodate the flow of molten metal and slag at the beginning of the pour.

This can be important in conventional, water-cooled furnaces wherein water cooling jackets are provided in the upper portions of the furnace above the tap hole. When discharging from such a furnace, care must be taken not to tilt the furnace too much during the initial part of the pour. If the furnace is tilted excessively during the initial part of the pour, then the great quantity of molten steel that is initially in the furnace could accidentally contact the upper, cooling jacket portions of the furnace. This can result in an explosion.

The present invention aids the operator of the furnace in avoiding excessive tilting of the furnace that could cause an explosion. In a preferred construction, the slag separating device is configured such that when the furnace is tilted too quickly, then the molten steel in the reservoir will flow out of the slag opening before the molten steel in the furnace makes contact with the cooling jackets inside the furnace. The flow of molten steel out of the slag opening may be observed by the operator, who can then reduce the angle of tile until steel stops flowing out of the slag opening. Thus, the undesirable contact between molten metal and the cooling jackets in the furnace is avoided.

This invention controls slag in a tap discharge of molten metal and floating slag by employing a novel apparatus and method for directing the flow of the slag and molten metal through a flow path in a trough and attached device in which the slag and molten metal are separately discharged in an efficient and effective manner.

Figure 8:
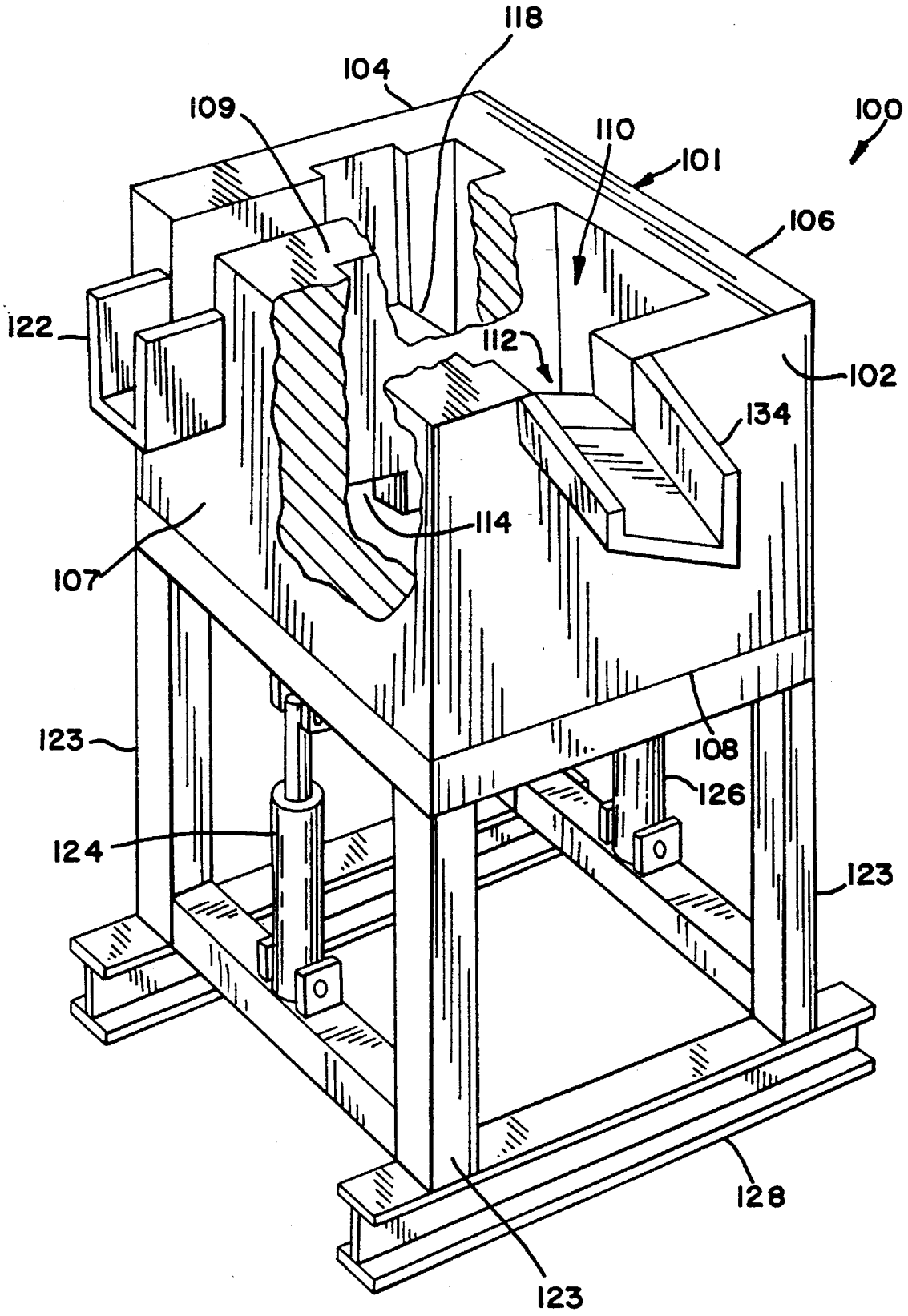
FIG. 8 is a simplified perspective view of a free standing slag separating unit in accordance with the invention with portions cut away to illustrate interior detail.

Referring to FIG. 8, an alternative embodiment of the invention is a tilting free-standing unit 100 having a vessel 101 with a design that is nearly identical to the slag separating device 24 attached to the tilting furnace 12 as described above. The vessel 101 has two side walls 102 and 104, a rear wall 106, a front wall 107, a bottom wall or floor 108 and an intermediate wall 109. A reservoir 110 is defined by the side wall 102, rear wall 106, intermediate wall 109 and front wall 107. The side wall 102 has a lateral opening 112. The intermediate wall 109 functions as a dam with a bottom opening 114 (hereinafter referred to as the dam opening 114) as its lower front end.

Figure 10:
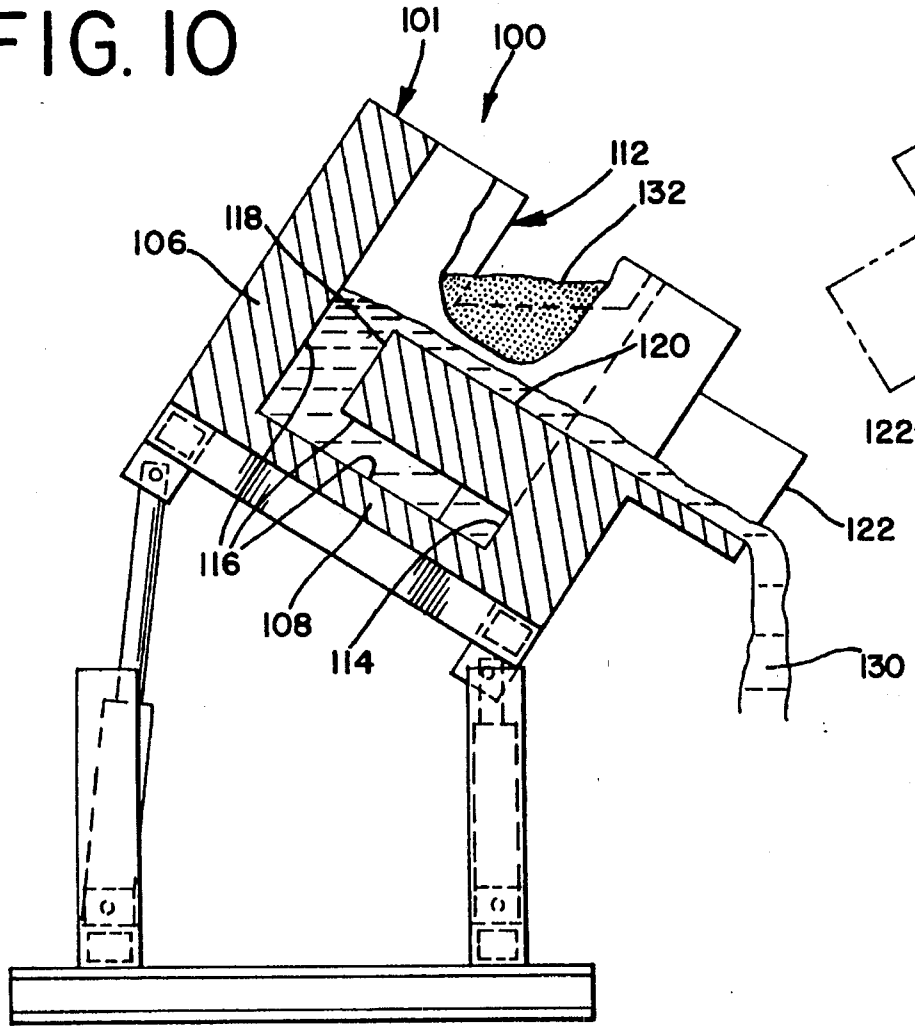
FIG. 10 is a cross-sectional view of the unit as shown in FIG. 9 with certain portions cut away to illustrate interior detail.

A passage 116 is defined in part by the intermediate wall 109 and side wall 104. Thus, the passage 116 is laterally offset from the reservoir 110. Referring to FIG. 10, the passage 116 extends rearwardly from the dam opening 114 and then upwardly between the rear wall 106 and a weir portion 118. A shelf portion 120 extends forwardly from the weir 118 to a discharge opening 122.

In a preferred embodiment, the dimensions, proportions and materials of the vessel 101, including the side walls 102 and 104, front wall 107, floor 108, intermediate wall 109, lateral opening 112, dam opening 114, passage 116, weir 118, shelf portion 120 and discharge opening 122 are the same as the materials, dimensions and proportions of the slag separating device 24, including its corresponding elements, as described above. The rear wall 106 is constructed from the same materials, and in the same dimensions and proportions as the other walls 102, 104, 107, 108 and 109. The locations of the lateral opening 112, the dam opening 114, passage 116, weir 118, shelf portion 120 and discharge opening 122 relative to each other, are identical to the locations of the corresponding elements in the slag separating device 24 described above. Therefore, except for the extension of the rear wall 106 across the entire rear end of vessel 101, vessel 101 is virtually identical to the slag separating device 24 described above.

Referring to FIG. 8, the vessel 101 rests on top of four support legs 123 (one leg not shown). the vessel 101 is not attached to the legs 123. A pair of hydraulic cylinders 124 and 126 are hingeably attached to the bottom of the unit 100. The hydraulic cylinders 124 and 126 extend downwardly from the vessel 101 and are hingeably attached to a base portion 128. The hydraulic cylinders 124 and 126 are actuated by conventional means for extending and retracting independently in a controlled manner. The hydraulic cylinders 124 and 126 function as additional legs that extend and retract in order to raise, lower or tilt the vessel 101.

Figure 9:
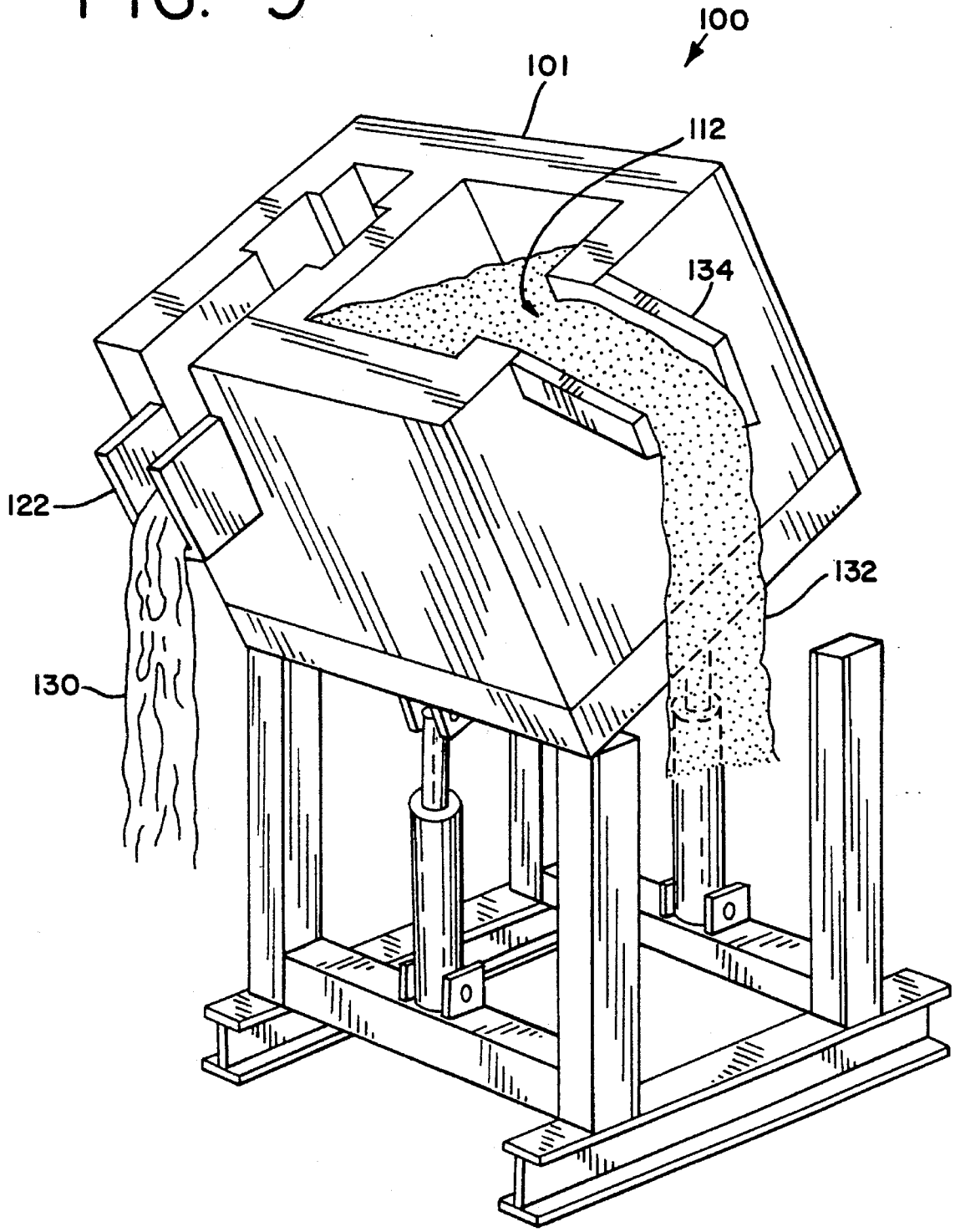
FIG. 9 is a perspective view of the free standing unit shown in FIG. 8 wherein the unit is tilted and molten metal and slag are being discharged.

In operation, molten metal and slag are poured into the reservoir 110 while the vessel 101 is level. The vessel 101 is then tilted by actuating one or both cylinders 124 and 126 in order to raise the rear end and/or lower the front end and tilt the vessel 101 forward. Referring to FIG. 9, slag 112 floats on top of molten metal (not illustrated).

Referring to FIGS. 9 and 10, when the vessel is tilted, molten metal 130 is discharged from the discharge opening 122 and slag 132 is discharged from the lateral opening 112. Within the vessel 101, molten metal 130 flows through the dam opening 114 and passage 116, over the weir 118 and shelf portion 120, and out of the vessel 101 through the discharge opening 122. Thus, the molten metal 130 flows rearwardly and then upwardly in the passage 116. As the molten metal 130 rises in the vertical portion of the passage 116, a pressure head is created which maintains a minimum depth of molten metal 130 in the reservoir 110 and prevents floating slag 132 from flowing through the dam opening 114 and out of the discharge opening 122. Floating slag 132 in the reservoir 110 flows out of the lateral opening 112 to a discharge chute 134.

The relative orientation, heights and distances of the lateral opening 112, dam opening 114 and weir 118, are identical to the relative orientation, heights and distances of the corresponding elements in the slag separating device 24 described above and function to maintain a minimum depth of molten metal 130 in the reservoir that prevents floating slag 132 from passing through the dam opening 114 as the vessel 101 is tilted. Further, these elements cooperate as the vessel 101 is tilted wherein the lateral opening 112 is lowered relative to the weir 118 as the vessel 101 is tilted in a manner identical to that described above regarding the slag separating device 24.

Figure 11:
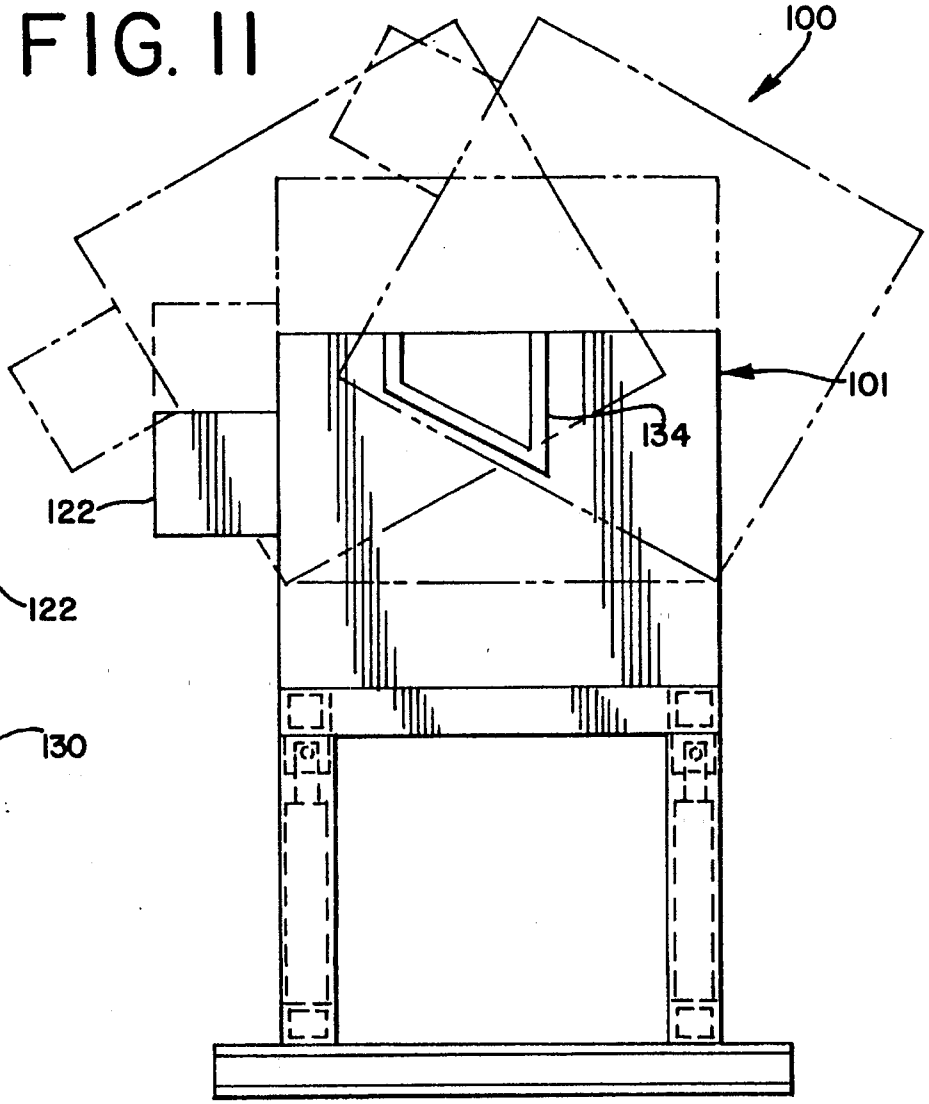
FIG. 11 is an elevational view of the slag separating unit shown in FIG. 8.

Referring to FIG. 11, the vessel 101 can be raised, tilted forwardly, or tilted rearwardly by the hydraulic cylinders 124 and 126 as shown by the phantom lines. Therefore, the vessel 101 may be moved to any height to receive and/or discharge molten metal and slag.

Figure 12:
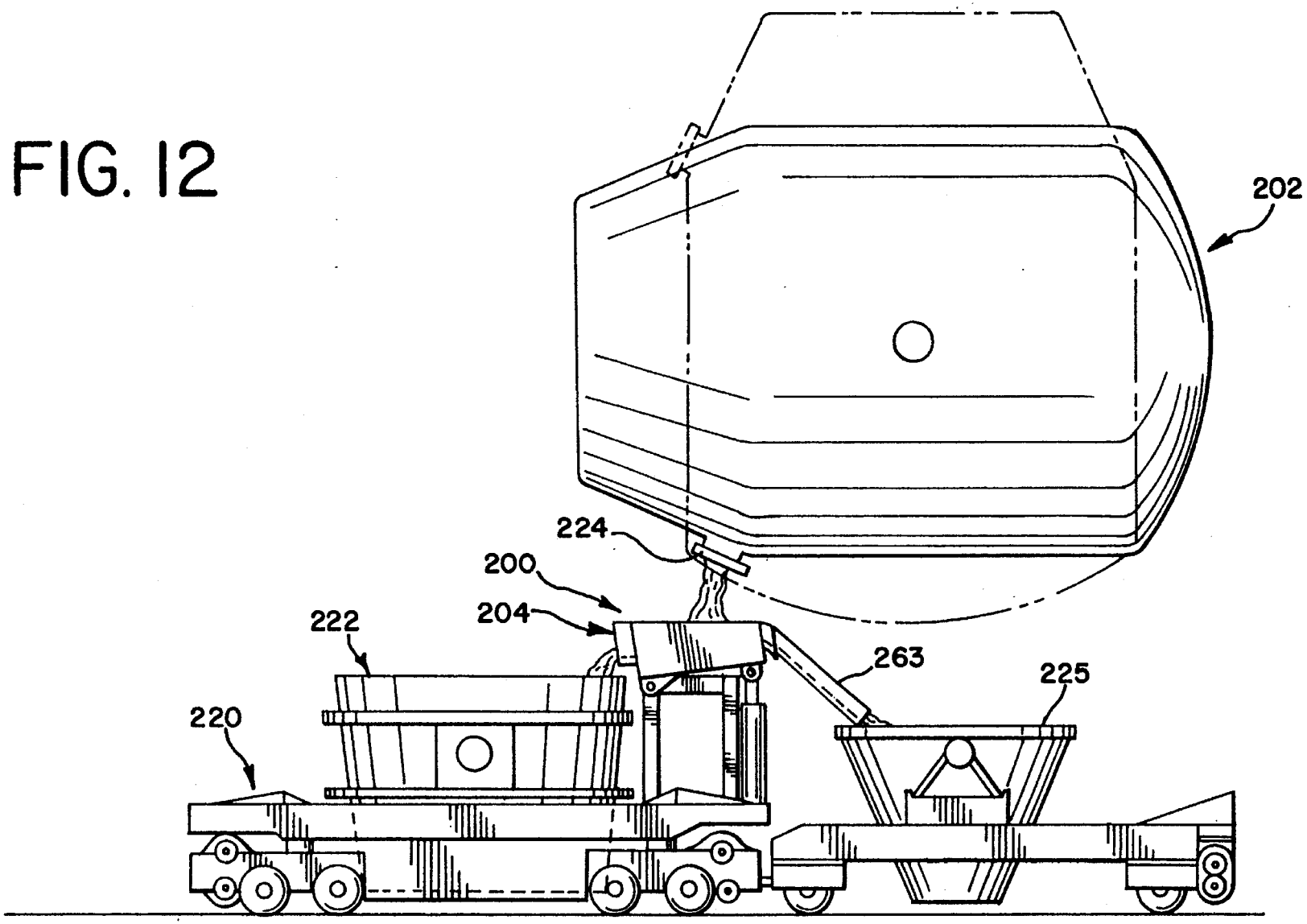
FIG. 12 is a simplified schematic view of a preferred embodiment of a tiltable and movable slag separating unit in accordance with the invention illustrated for use with a rotating furnace and attached to a frame of a molten metal car or ladle which has a slag car attached thereto.
Figure 13:
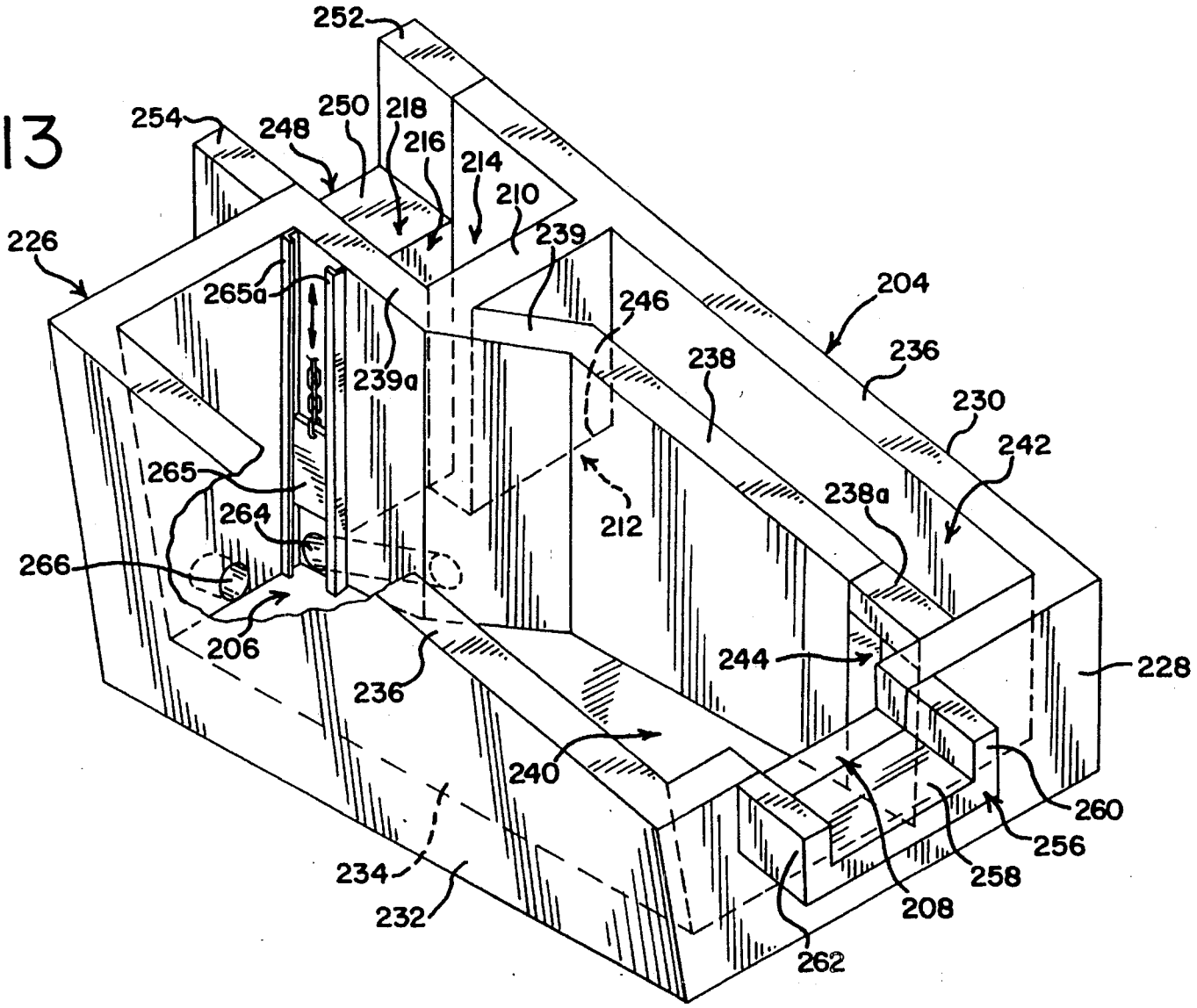
FIG. 13 is a simplified perspective view of the slag separating unit shown in FIG. 12 with portions cut away to illustrate interior detail and positioned in a normal upright position.

Referring to FIGS. 12, 13 and 15–20, an alternative embodiment of the invention is illustrated. As FIG. 12 shows, this embodiment includes a tilting and movable unit 200 which receives molten metal and slag from a rotatable furnace 202. The unit 200 includes a vessel 204 which, as FIG. 13 illustrates, includes a reservoir 206 having a slag outlet 208, a dam 210, a dam opening 212 and a passage 214. The passage 214 is defined in part by a weir 216 and it leads to a molten metal outlet 218.

As FIG. 12 illustrates, the rotating furnace 202 typically is utilized with a movable container or ladle car 220 which includes a molten metal container or ladle 222 thereon. In the prior art, the ladle 222 typically is positioned beneath the rotating furnace 202 and accepts molten metal and slag in a free-falling flow as described herein.

The rotating furnace 202 is rotatable between a non-discharging, vertical upright position, which generally is illustrated in dotted lines in FIG. 12, and a rotated, discharging position, illustrated in solid lines. In a fully rotated position, a typical rotating furnace 202 is rotated between about 80–100 degrees from the vertical.

The furnace 202 includes a tap hole 224 through which molten metal and slag are discharged. As in the tilting electric furnace discussed herein, a floating layer of slag forms on top of the molten metal (not illustrated) within the rotating furnace 202. Once the furnace 202 is rotated to the discharge position illustrated in solid lines, the molten metal drains from the tap hole 224 while the slag floats on top of the molten metal. The molten metal is discharged first with the floating slag being positioned above the molten metal for discharge after substantially all the molten metal is discharged from the furnace 202. When molten metal is fully drained from the furnace 202, an operator stops the flow of material from the furnace 202 by rotating the furnace 202 back toward the vertical position.

In the present invention, the ladle car 220 includes the unit 200 attached to one end thereof. The unit 200 receives the flow of material from the furnace 202, reduces turbulence caused by the free-falling flow into the vessel 204, separates the molten metal from the slag, distributes the molten metal to the ladle 222 and discharges the slag to a slag container 225 or a slag pit (not illustrated). Details of the unit 200 now will be provided.

The vessel 204 preferably is fabricated from suitable steel plated shell members and structural support members (not illustrated), and the shell members are lined with refractory material, such as a conventional or special case refractory material or refractory brick. The composition of the refractory material can vary depending on the temperature requirements. In a preferred form of the invention, the shell members are lined with refractory paper, such as that sold under the trademark FIBERFRAX, with refractory brick placed on top of the paper.

As FIG. 13 illustrates, the vessel 204 is defined by a front wall 226, a rear wall 228, two side walls 230 and 232, a bottom wall or floor 234, a top edge 236 and an intermediate wall 238. The intermediate wall 238 substantially separates the reservoir 206 into first and second portions or chambers 240 and 242 which are interconnected proximate the rear wall 228 by an opening 244. Thus, the reservoir 206 is preferably "U" shaped when viewed from above the vessel 204.

In a preferred form of the vessel 204, approximately 230 tons of molten metal and slag can be separated in approximately 8 minutes. The overall dimensions of the vessel 204 are 10 feet long with a height of 6 feet at the front wall 226 and a height of 3.5 feet at the rear wall 228. The width across the entire bottom wall 234 is 6 feet. The width at the top edge 236 of the front wall 226 is 6 feet 8 inches. The width at the top edge 236 of the rear wall 228 is about 6 feet 5 inches.

The dam 210 is about 12 inches thick, the front wall 226 is about 13.50 inches thick, the rear wall 228 is about 9 inches thick, the side wall 230 is about 9 inches thick, the side wall 232 is about 9 inches thick, the bottom wall 234 is about 9 inches thick, and the intermediate wall 238 is about 12 inches thick.

The first chamber 240 of the reservoir 206 is about 97.50 inches long with a width of about 22 inches proximate the bottom of the front wall 226 and a width of about 30 inches proximate the top of the front wall 226. The first chamber 240 has a width of about 30 inches proximate the bottom of the rear wall 228 and a width of about 33 inches proximate the top of the rear wall 228.

The second chamber 242 of the reservoir 206 is about 65 inches long with a width of 12 inches proximate the rear wall 228 and a width of 20 inches proximate the dam 210.

The dam 210 has a height of about 55 inches and a width of about 20 inches with the dam opening 212 being about 6 inches high and 20 inches wide. The passage 214 is about 20 inches wide and 12 inches across, and is defined in part by a weir 216 that is 20 inches high.

The molten metal outlet 218 is about 20 inches wide and 42 inches from the bottom of the vessel 204, while the slag outlet 208 is about 20 inches wide and 36 inches from the bottom of the vessel 204.

The opening 244 is approximately 12 inches wide and 36 inches high. The channel 264 is about 6 inches in diameter and the drain hole 266 is about 4 inches in diameter. It is to be understood, however, that the dimensions of the vessel 204 can be larger or smaller than described above.

To provide the desired flow of molten metal and slag out of the vessel 204, the top edge 236 of each side wall 230 and 232 as well as the top edge of the intermediate wall 238 are oriented at an angle of approximately 15°–25° downwardly from the front wall 226. Thus, the front wall 226 is taller or longer than the rear wall 228 which assists in providing the unique separating and discharge features of the present embodiment.

The side wall 232 is oriented at an angle outwardly from the intermediate wall 238 to provide a wider opening to receive the flow of molten metal and slag from the furnace 202. This also assists in reducing the initial turbulence in the flow in the first chamber 240 of the reservoir 206.

In order to assist in stabilizing the intermediate wall 238, a brace 238*a* can extend between the intermediate wall 238 and the rear wall 228 along the top edge 236. The opening 244 thus extends under the brace 238*a*.

The intermediate wall 238 includes an angled portion 239 connected to the dam 210 and an end portion 239*a* which defines a wall of the passage 214. Accordingly, the first and second chambers 240 and 242 fan out in a downstream direction which creates a reverse venturi to assist in slowing down the flow and providing a desired pooling of molten metal and a desired non-turbulent or laminar flow in the chambers as described below.

Figure 15:
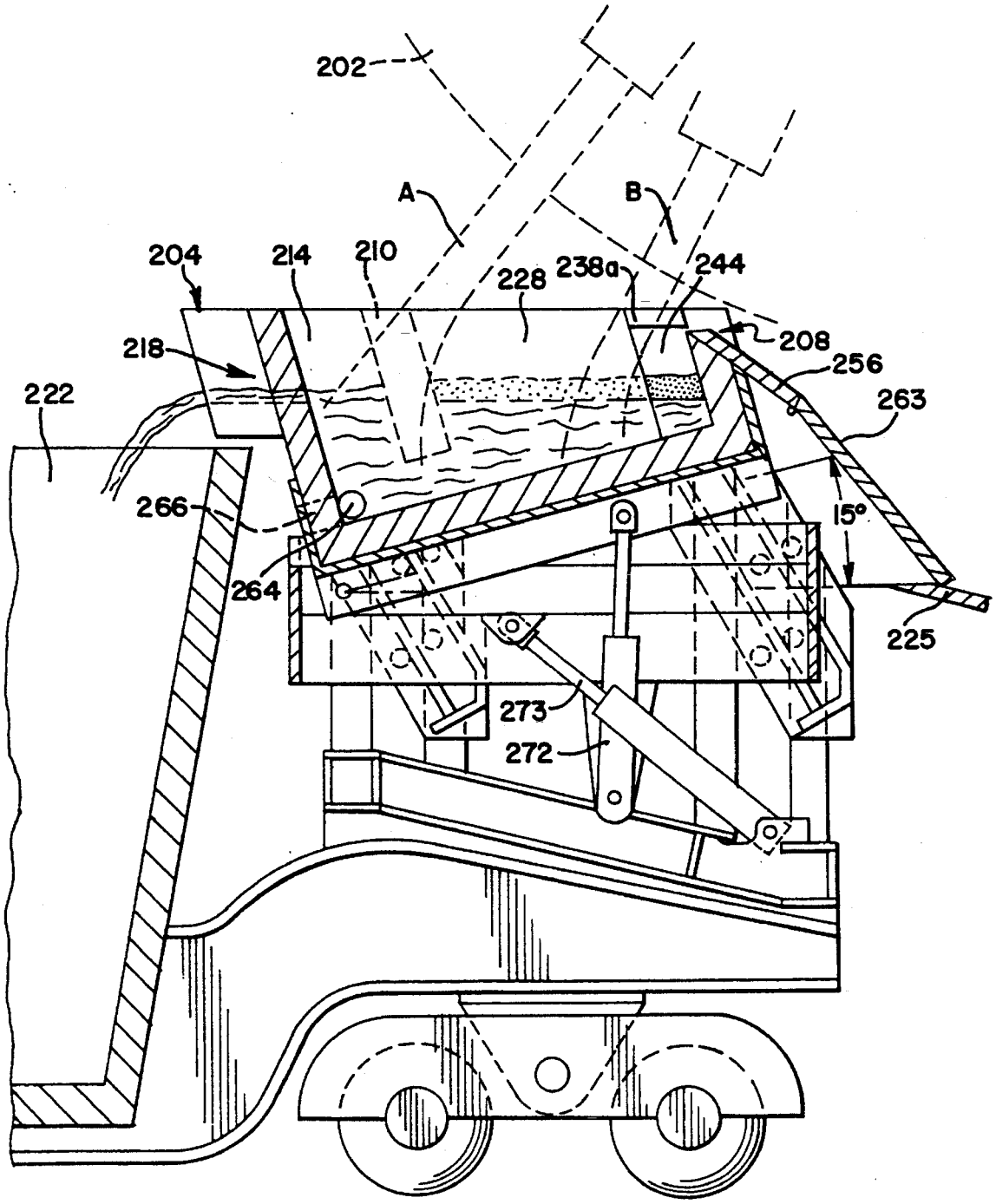
FIG. 15 is a fragmentary cross-sectional view of the slag separating unit and molten metal car illustrated in FIG. 12 wherein the unit is tilted forwardly about 15 degrees from the normal upright position shown in FIG. 13, with interior details of the unit, the rotating furnace and two possible free-falling flow positions of the furnace illustrated in dotted lines and wherein the levels of molten metal and slag in the unit are shown while molten metal is being discharged into the molten metal car or ladle.
Figure 16:
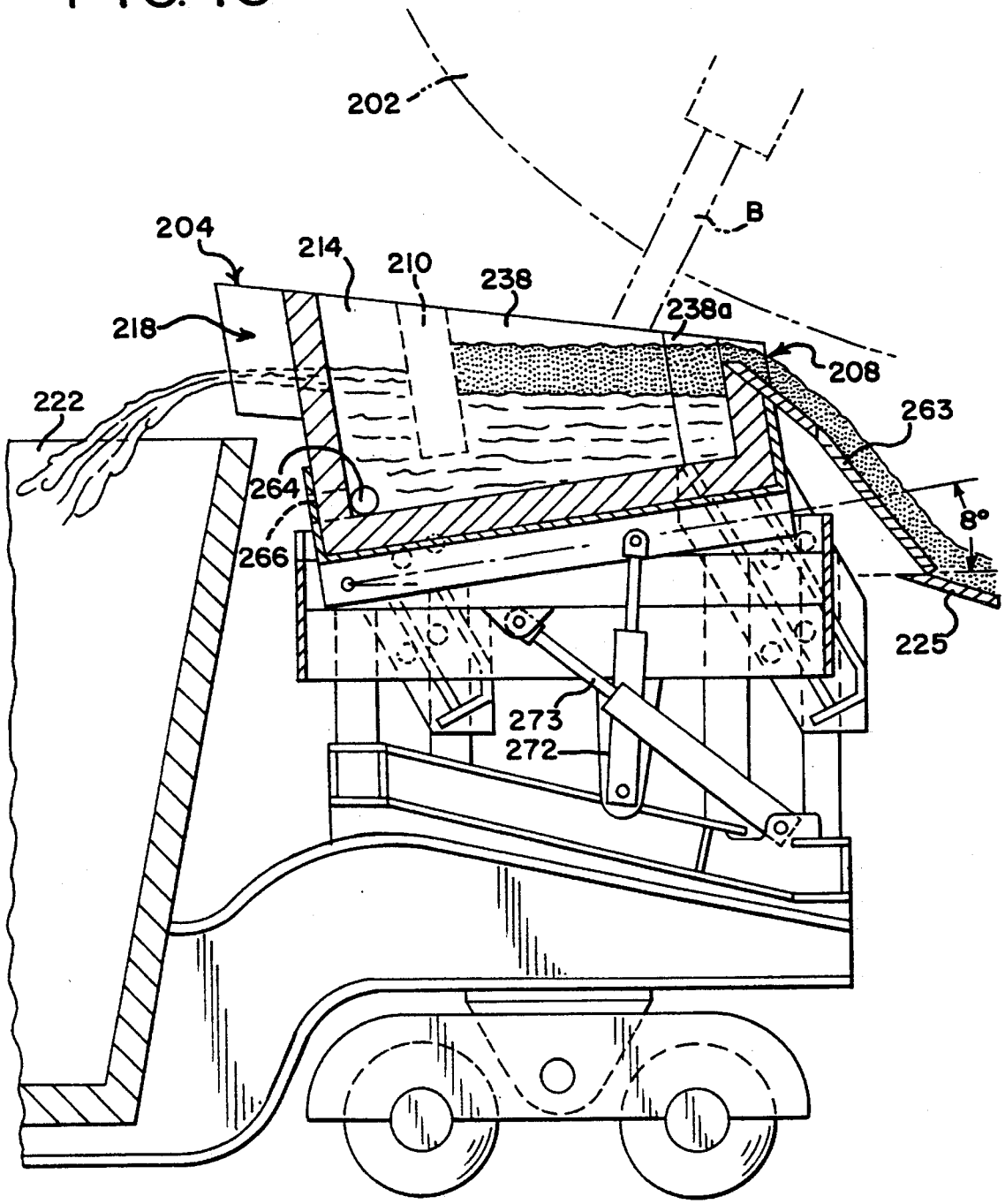
FIG. 16 is a view similar to FIG. 15 but showing the slag separating unit tilted forwardly about 8 degrees from the normal upright position shown in FIG. 13 and illustrating levels of molten metal and slag within the unit while both molten metal and slag are being discharged.

The reservoir 206 has a predetermined flow path for the flow of molten metal and slag which substantially begins at the first chamber 240, and extends through the opening 244 and into the second chamber 242. When the vessel 204 is positioned for use as FIGS. 15 and 16 illustrate, the flow path initially runs uphill against gravity in the first chamber 240, turns 90° into the opening 244 and turns another 90° into the second chamber 242 where it runs downhill with gravity. The particular design of this flow path reduces turbulence, permits the separation of molten metal and slag wherein the slag floats on top of the molten metal and provides substantially a laminar flow within the second chamber 242.

As FIG. 15 illustrates, the furnace 202 initially provides a flow of molten metal and slag into the first chamber 240 of the reservoir 206 at a first position indicated by the reference letter "A". As the pour out of the furnace 202 continues, the furnace 202 is rotated which moves the flow position and the point of impact within the first chamber 240 to a second position "B" with a range of positions extending between positions "A" and "B" as pouring and rotation of the furnace 202 continues. Thus, the first chamber 240 must be elongated to accommodate the change in flow positions without having to move the vessel 204.

Referring to FIG. 13, the slag outlet 208 preferably is positioned in the rear wall 228 proximate the first chamber 240 of the reservoir 206 and is formed as a slot open to the top edge 236 of the vessel 204 The particular length, width, shape and position of the slag outlet 208, however, can vary so long as the unit 200 functions as described herein.

Figure 20:
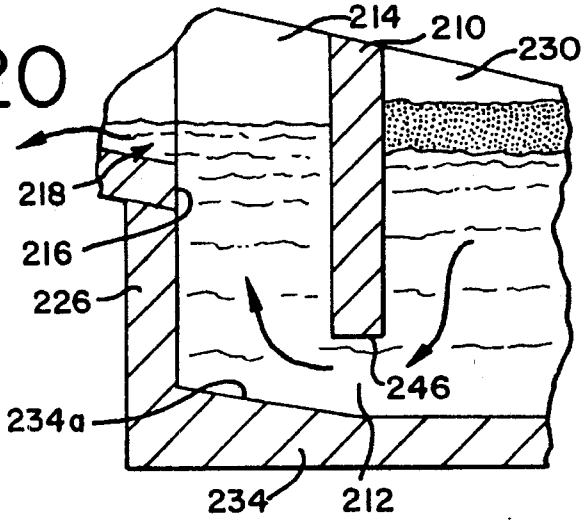
FIG. 20 is a fragmentary cross-sectional view taken generally along the plane 20—20 of FIG. 19 generally illustrating the dam and weir structure of the slag separating unit, the flow of molten metal under the dam and over the weir, and the slag retained by the dam.

The dam 210 is positioned in the downstream end of the second chamber 242 of the reservoir 206, and extends between the side wall 230 to the intermediate wall 238 and from the top edge 236 to a bottom edge 246 spaced from the bottom wall 234 of the vessel 204. Referring to FIG. 20, the bottom edge 246 is positioned a predetermined distance away from the bottom wall 234 to form the dam opening 212.

The dam opening 212 extends across the second chamber 242 of the reservoir 206 between the side wall 230 and the intermediate wall 238 and has a height corresponding to the distance between the bottom wall 234 and the bottom edge 246 of the dam 210.

The passage 214 is aligned with the second chamber 242 of the reservoir 206. Molten metal flows into the passage 214 from the second chamber 242 through the dam opening 212. The passage 214 is defined by the dam 210 and portions of the front wall 226, the side wall 230 and end portion 239*a* of the intermediate wall 238 of the vessel 204.

Referring to FIG. 20, the bottom of the passage 214 is defined by a sloped portion 234*a* of the bottom wall 234 of the vessel 204. The sloped portion 234*a* is oriented at a 10° angle with respect to the bottom wall 234, but the angle can vary. The purpose of the angle is to create a low point in the second chamber 242 that is directly beneath the dam 210 when the vessel is tilted slightly.

The metal outlet 218 preferably is positioned in the portion of the front wall 226 which is adjacent the passage 214 and extends substantially across the entire width of the passage 214. The portion of the front wall 226 beneath the metal outlet 218 functions as a weir 216 and thus creates a pressure head so as to maintain a minimum depth of molten metal in the vessel.

Referring to FIG. 13, to assist in directing the flow of molten metal from the metal outlet 218, a chute 248 can be provided having a bottom surface 250 and opposite sides 252 and 254. To provide the desired flow of molten metal, the bottom surface 250 of the chute 248 is positioned at an upward sloping angle with respect to the bottom wall 234 of the vessel 204. The angle of the chute 248 is between 10°–25°, but can vary.

Similarly, the slag outlet 208 can include a chute 256 for directing the flow of slag. The chute 256 is defined by a bottom surface 258 and opposite sides 260 and 262. Preferably, the chute 256 is positioned at a downward sloping angle with respect to the bottom wall 234 of the vessel 204 for providing a flow of slag into the container 225, or into a trough or slag pit. The angle of the slag chute 256 preferably is between 30°–50° (see FIG. 15), but can vary.

Preferably, both the molten metal chute 248 and slag chute 256 are fabricated from steel support plates to form a shell in which refractory materials are placed to form lined discharge chutes.

Referring to FIG. 15, to provide the flow of slag between the slag chute 256 and the slag container 225, an adjustable slag trough 263 can be included. The slag trough 263 is adjustable to accommodate the movements of the vessel 204 as described herein and preferably is hingably attached to the slag chute 256. It is to be noted, however, that the slag trough 263 can be secured in any desired way so long as the adjustability and slag flow are provided as described herein.

Referring to FIG. 13, in order to initially charge the passage 214 with molten metal to create a seal in the dam opening 212 so that only molten metal flows out of the metal outlet 218, the intermediate wall 238 may optionally include a channel 264 proximate the front wall 226 of the vessel 204. The channel 264 connects the first reservoir chamber 240 to the passage 214 at a location directly under the dam 210 and substantially within the dam opening 212. The charging of the passage occurs when molten metal initially flows through the channel 264 before slag flows through the first and second chambers 240 and 242 in the reservoir 206 and reaches the dam 210.

In order to receive a flow of a small amount of slag that may be initially discharged from the furnace 202, the channel 264 preferably is closed by a plate 265 to prevent the flow of slag through the channel 264. The plate 265 slides within guides 265a in a "guillotine" manner and is lowered manually or with some type of mechanism (not illustrated) to cover the channel 264. Thereafter, when the molten metal is discharged from the furnace and begins to fill the vessel, the molten metal melts the plate 265 and thereby opens the channel for charging of the passage 214.

It is to be understood that the vessel 204 need not have the channel 264 and therefore the passage 214 need not be initially charged by flow through the passage 264.

In order to drain any residual molten metal and/or slag from the vessel 204 after a majority of the metal and slag have been discharged through the metal outlet 218 and slag outlet 208, respectively, the reservoir 206 preferably includes a drain or tap hole 266. The drain hole 266 is positioned in the front wall 226 of the vessel 204 proximate the bottom wall 234 for draining as described below.

Figure 18:
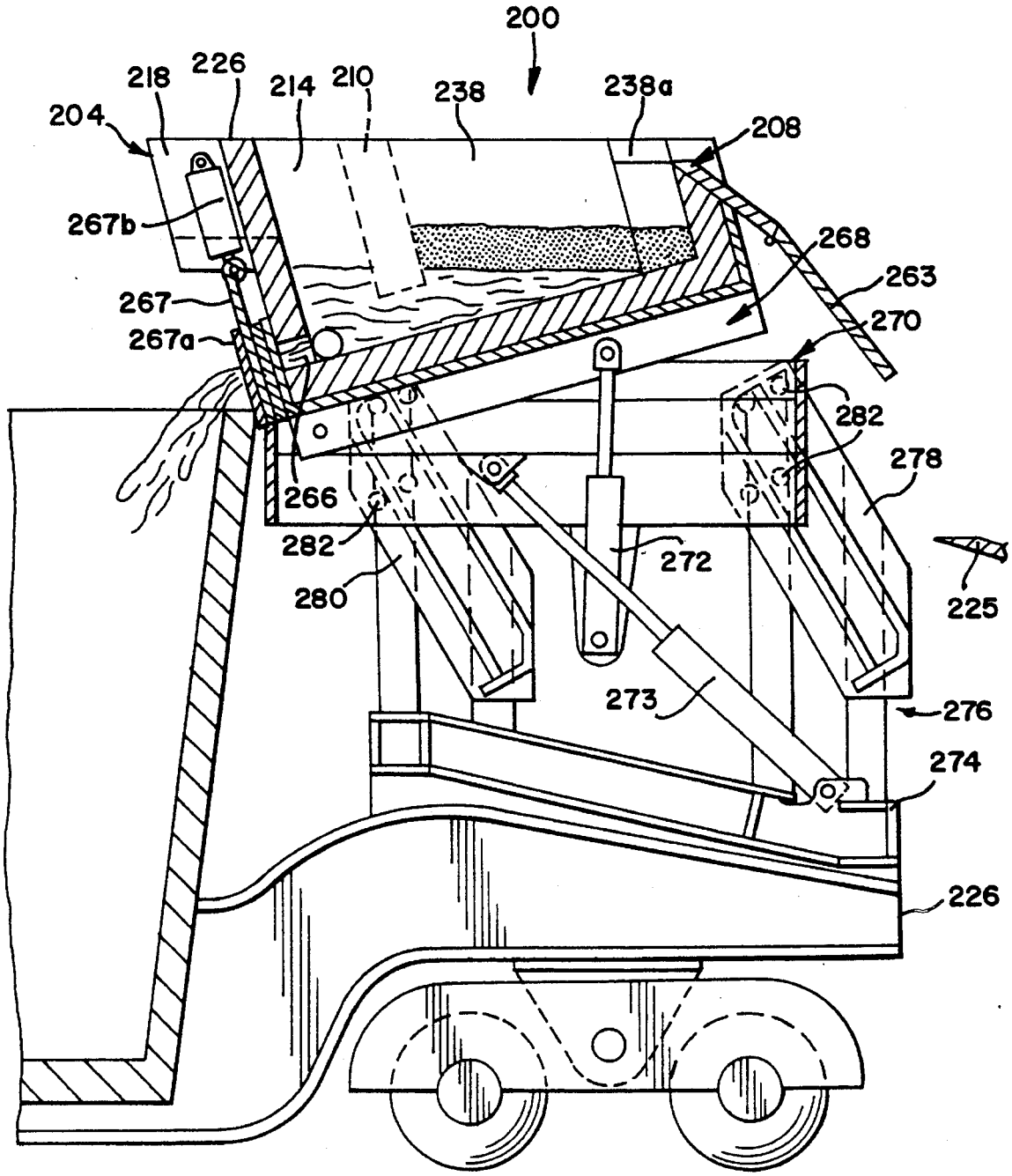
FIG. 18 is a view similar to FIGS. 15–17 but showing the slag separating unit positioned for draining residual molten metal and slag generally illustrated in FIG. 17 into the molten metal car.

In order to prevent material from exiting the drain hole 266, a method of plugging the drain hole 266 is utilized which is referred to as "ladle nozzle sand" and generally is illustrated in FIG. 18. With this method, a gate or plate 267 is mounted within a frame 267*a* which is attached to the front wall 226 of the vessel 204. The gate 267 is activated by hand or with a hydraulic member 267*b* or the like. The gate 267, frame 267*a*, and wall 226 substantially provide a box which is filled with silica sand (not illustrated) prior to use. Additionally, prior to use, the drain hole 266 is filled with zirconium sand (not illustrated).

When the gate 267 is raised, the residual molten metal in the vessel 204 pushes out both the zirconium sand from the drain hole 266 and the silica sand from the box. The sand is discharged into a pipe (not illustrated) and the molten metal flows through the drain hole and into the ladle 222.

As FIGS. 15–18 illustrate, the unit 200 is designed for tilting as well as horizontal and vertical movement. Referring to FIG. 18, to provide such movement, the vessel 204 is connected to a tiltable table 268 which in turn is hingedly connected to a moving or rolling table 270. Each table 268 and 270 preferably is actuated by a respective pair of hydraulic cylinders 272 and 273, only one cylinder of each pair being shown. If necessary, additional hydraulic cylinders can be utilized to assist in providing the desired movement and tilting of the vessel 204.

The hydraulic cylinders 272 and 273 extend downwardly from the tables 268 and 270. The bottom of cylinder 273 preferably is hingably attached to another structure, such as a frame portion 274 which in turn is attached to the ladle car 226. The bottom of the cylinder 272 is attached to the moving table 270. The hydraulic cylinders 272 and 273 are actuated by conventional means for extending and retracting independently in a controlled manner.

To control the vertical and horizontal movement of the vessel 204 by actuation of the hydraulic cylinders 273, a guide structure 276 is provided. The guide structure 276 substantially includes two guide tracks 278 and 280 which cooperate with guide rollers or casters 282 provided on the moving table 270. Accordingly, upon actuation of the hydraulic cylinders 273, the guide rollers 282 ride within the guide tracks 278 and 280 to position the vessel 204. As illustrated in FIG. 18, the vessel may be moved so that the drain hole 266 is positioned over the ladle 222 for draining. If desired, a latching mechanism (not illustrated) can be included for maintaining the position of the vessel 204 on the tracks.

Figure 14:
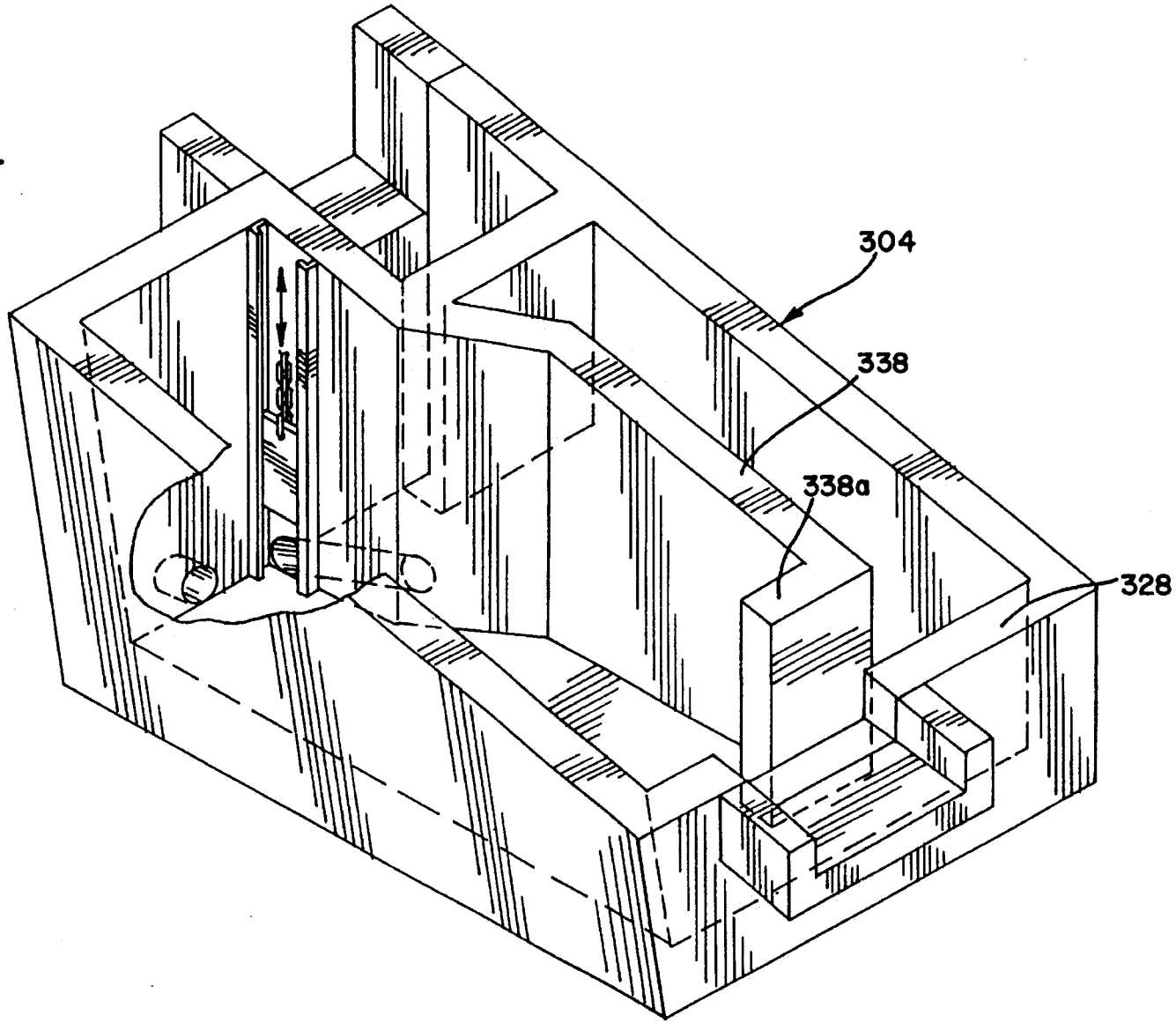
FIG. 14 is a simplified perspective view of an alternate embodiment of a tiltable and movable slag separating unit in accordance with the invention with portions cut away to illustrate interior details and positioned in a normal upright position.

Referring to FIG. 14, an alternative embodiment of the vessel of the invention is designated with the reference numeral 304. The vessel 304 substantially is identical to the vessel 204 of FIG. 13 with the exception of the formation of the intermediate wall 338. In this embodiment, the intermediate wall 338 includes a retention wall section or baffle 338*a* positioned at its end proximate the rear wall 328. The retention wall section 338*a* extends a predetermined distance into the first reservoir chamber 240 and can be employed to further reduce turbulence, if desired.

In operation, primarily molten metal is initially poured from the furnace 202 into the first chamber 240 of the reservoir 206 with the vessel 204 positioned in a first position as indicated in FIG. 15. The exit point from the furnace is at a predetermined position and height above the vessel. In this position, the vessel 204 is tilted by actuating hydraulic cylinders 272 to tilt the vessel to an angle of approximately 15 degrees with respect to a horizontal plane.

As the molten metal is poured from the furnace 202, the furnace 202 rotates and the position of the free-falling discharge moves from position A to position B. The elongated first chamber provides an elongated receiving zone for receiving the discharge in each position between positions A and B.

When the molten metal flowing from the furnace impacts the bottom 234 of the vessel 204, a substantial amount of turbulence is created. The molten metal begins to fill the first chamber 240 of the reservoir 206, the second chamber 242, and the passage 214. If the channel 264 is employed in the intermediate wall 238, then the passage 214 will be partially filled and charged before the second chamber is filled. Once the level of molten metal within the first chamber 240, second chamber 242 and passage 214 substantially is equalized and is above the level of the dam opening 212, a molten metal "seal" is established in the dam opening 212 and all floating slag will be retained by the dam within the reservoir 206. This process is also referred to as "charging" the unit. Thus, once the dam opening is sealed, and the unit is charged, only molten metal can flow out of the molten metal outlet 218.

As molten metal continues to pour from the furnace and into the reservoir 206, slag may accompany it. Since the metal is much denser than the slag, the metal drives downwardly and settles toward the bottom 234 of the reservoir 206 and the slag rises and floats on top of the metal.

Figure 19:
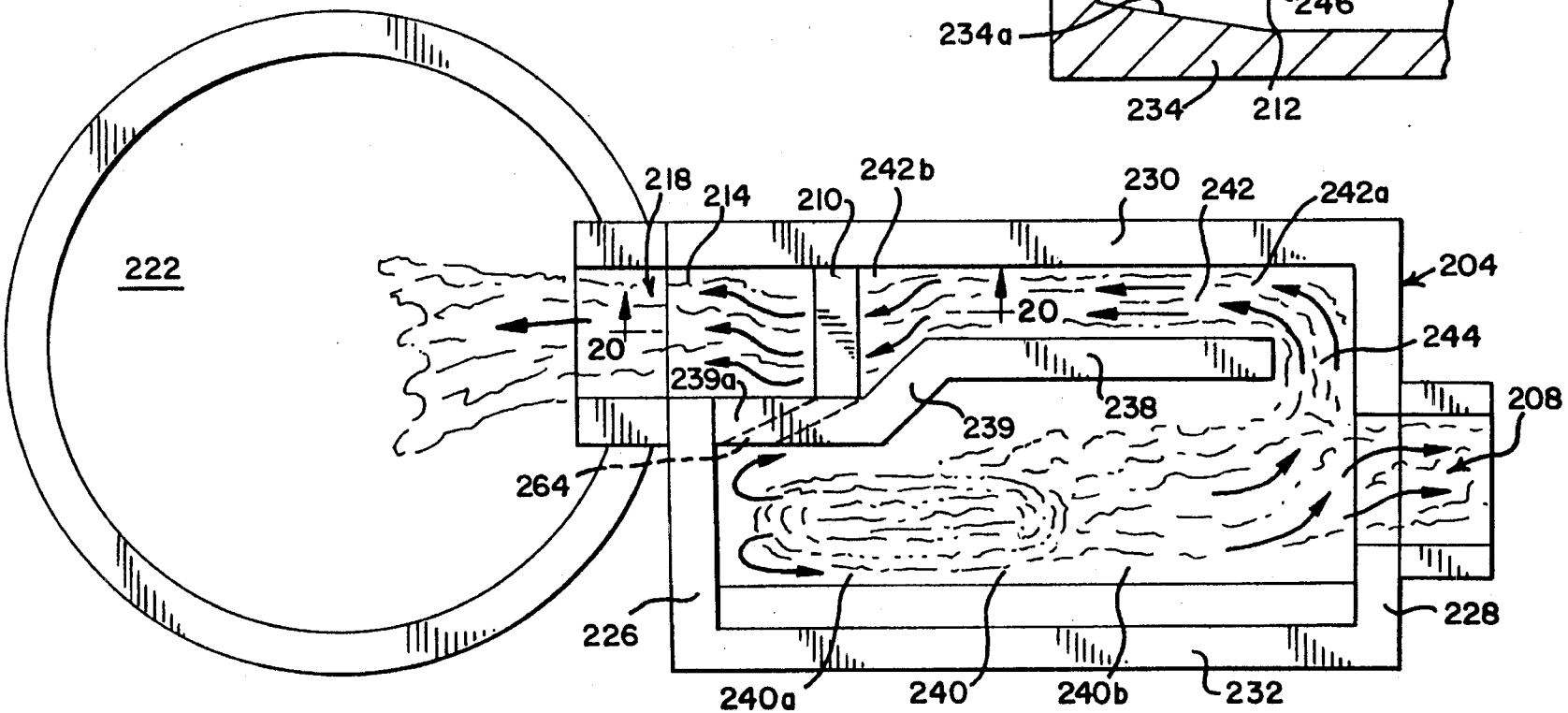
FIG. 19 is a top plan view of the slag separating unit shown in FIG. 13 (while in the flow position illustrated in FIG. 16) illustrating the flow of molten metal and slag through and out of the unit as well as the elongated impact zone for receiving the free-falling flow of molten metal and slag.

As the level of metal and slag rises within the reservoir 206, it generally flows rearwardly and upwardly along the tilted bottom of the first chamber 240 until it reaches the opening 244 and then flows into the second chamber 242 of the reservoir 206. The molten metal and slag then flow forwardly and downwardly along the slope of the bottom of the second chamber toward the dam 210. Thus, as illustrated in FIG. 19, the molten metal and slag flow in a substantially U-shaped flow path from the first chamber 240, to the opening 244, and through the second chamber 242. As FIG. 20 illustrates, the molten metal then flows under the dam 210, through the dam opening 212, and into the passage 214.

It is to be noted, however, that as the slag enters the second chamber 242, that the second chamber 242 may already be charged as discussed above. Thus, virtually no slag passes under the dam 210 which makes the discharge of molten metal from the vessel very pure.

As the levels of molten metal and slag continue to rise within the vessel 204, the level of molten metal within the passage 214 rises generally upwardly along the weir 216 until it overflows the weir and flows out of the metal outlet 218 into the ladle 222 as illustrated in FIG. 15. Since very little slag is being emitted from the furnace 202 during the initial portion of the pour, the level of slag may not rise above the level of the slag outlet 208 and thus is retained within the vessel 204. In the event the slag level does rise above the level of the slag outlet 208, it can flow out of the slag chute 256 for disposal.

As FIG. 15 illustrates, the flow of metal and slag within the reservoir 206 follows a predetermined flow path which reduces turbulence from the free-falling flow, provides the desired separation of the molten metal and slag, and reduces the turbulent flow to a non-turbulent or laminar flow. Due to the tilt of the vessel 204 in this first position, the bottom 234 of the vessel 204 substantially is tilted and oriented at an angle upwardly from the front wall 226 to the rear wall 228.

Also, it is noted that when the vessel 204 is in an operating or metal discharging position as shown in FIGS. 15 and 16, then the bottom of the first chamber 240 is oriented at an angle rearwardly and upwardly and the bottom of the second chamber 242 is oriented at an angle forwardly and downwardly. Thus, the flow of material in the first chamber 240 of the reservoir 206 generally is uphill against the flow of gravity while the flow in the second chamber 242 generally is downhill with the flow of gravity. This design is believed to contribute to reducing the turbulent flow to a laminar flow and permitting separation of the molten metal and slag within the reservoir 206.

Referring to FIG. 19, the intermediate wall 238 has an angled portion 239 that results in a tapering of the first chamber 240 and a tapering of the second chamber 242. As the molten metal and slag flow in the first chamber 240, the flow moves from a narrow section 240*a* to a wide section 240*b*. Similarly, as the molten metal and slag flow in the second chamber 242, the flow moves from a narrow section 242*a* to a wide section 242*b*. As the flow moves from a narrow section to a wide section, its velocity slows so as to facilitate pooling of the flow. Pooling results in an increased residence time in the reservoir which facilitates the separation of the molten metal and slag. Also, pooling aids is reducing the turbulence and establishing a laminar flow. Thus, when the flow reaches the dam opening 212, the flow is substantially laminar and non-turbulent, and the slag has fully separated from, and risen to the top of, the molten metal where it is retained by the dam 210.

Additionally, due to the size of the vessel 204 and the size of the chambers and opening therein, a substantial amount of molten metal and slag can be contained and separated therein. Also, a larger amount of slag can accumulate within the reservoir 206 before the vessel 204 needs to be tilted to a second position as described below. Thus, the large size of the vessel 204 and of the chambers and openings therein permit the processing of large volumes of molten metal and slag in a short time.

As the pour continues, the volume of slag flowing out of the furnace 202 increases. Consequently, the slag builds up within both chambers 240 and 242 of the reservoir 206. An operator monitors the flow and activates the tilting hydraulic cylinders 272 accordingly to decrease the tilt of the vessel 204 to a second position illustrated in FIG. 16 wherein the vessel 204 is oriented at an angle of approximately 8 degrees with respect to a horizontal plane. In this position, slag discharges from the slag outlet 208. The slag discharge increases in this position since the level of the slag outlet 208 is lowered relative to the weir 216 and relative to the level of the molten metal in the vessel 204. However, in this position, the level of the slag opening 208 remains slightly above the level of the molten metal outlet 218 and weir 216. Additionally, molten metal is still being discharged from the metal outlet 218 in this position.

Figure 17:
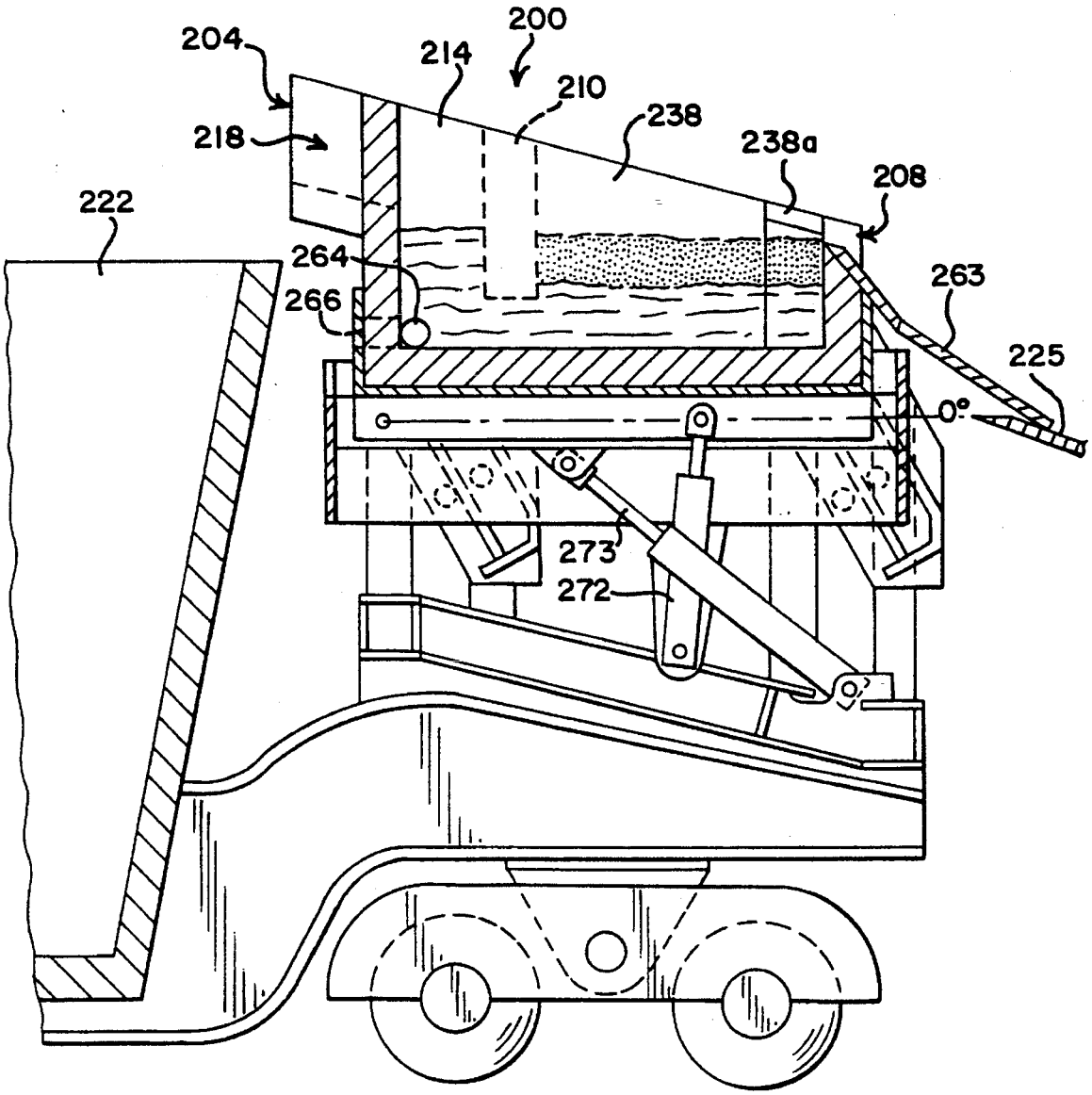
FIG. 17 is a view similar to FIGS. 15 and 16 but showing the slag separating unit back in the normal upright position shown in FIG. 13 and illustrating levels of molten metal and slag within the unit after the flow of molten metal and slag into the unit has ceased and no molten metal or slag is being discharged.

As the pour from the furnace 202 finishes, the vessel 204 preferably is gradually rotated to the position illustrated in FIG. 17 where the vessel 204 substantially is parallel to a horizontal plane. In this position, the flow of molten metal and slag out of the vessel 204 ceases, but an amount of residual molten metal and slag still are present in the reservoir 206. In this position, the level of the slag outlet 208 is slightly below the level of the molten metal outlet 218 and weir 216.

In order to remove this residual metal and slag, the operator activates the moving hydraulic cylinders 273 which raise the moving table 270 along the guide tracks 278 and 280 to lift the vessel 204 to the position indicated in FIG. 18. In this position, the drain hole 266 is positioned above the top of the ladle 222 and the tilting hydraulic cylinder 272 is activated to tilt the vessel 204 forward. The drain hole 266 then is opened to allow the residual metal and slag to flow out of the vessel 204 into the ladle 222 or any other desired container.

Figure 21:
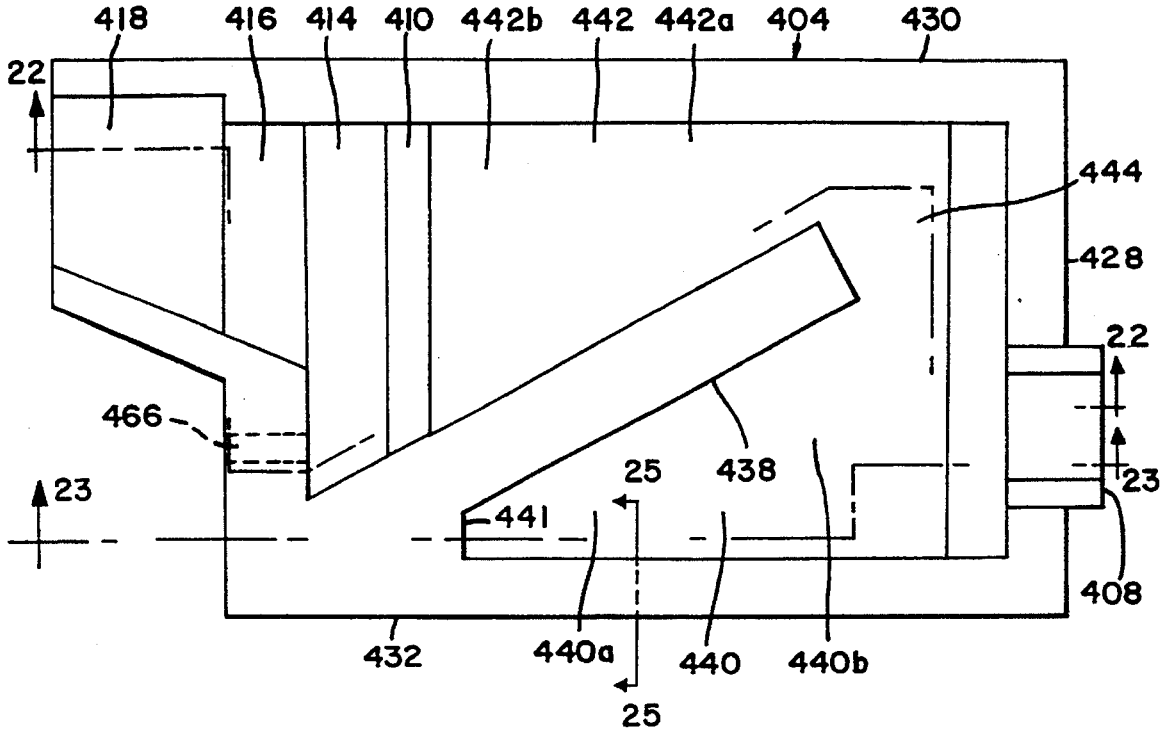
FIG. 21 is a plan view of an alternative embodiment of a tiltable and movable slag separating unit in accordance with the invention.
Figure 22:
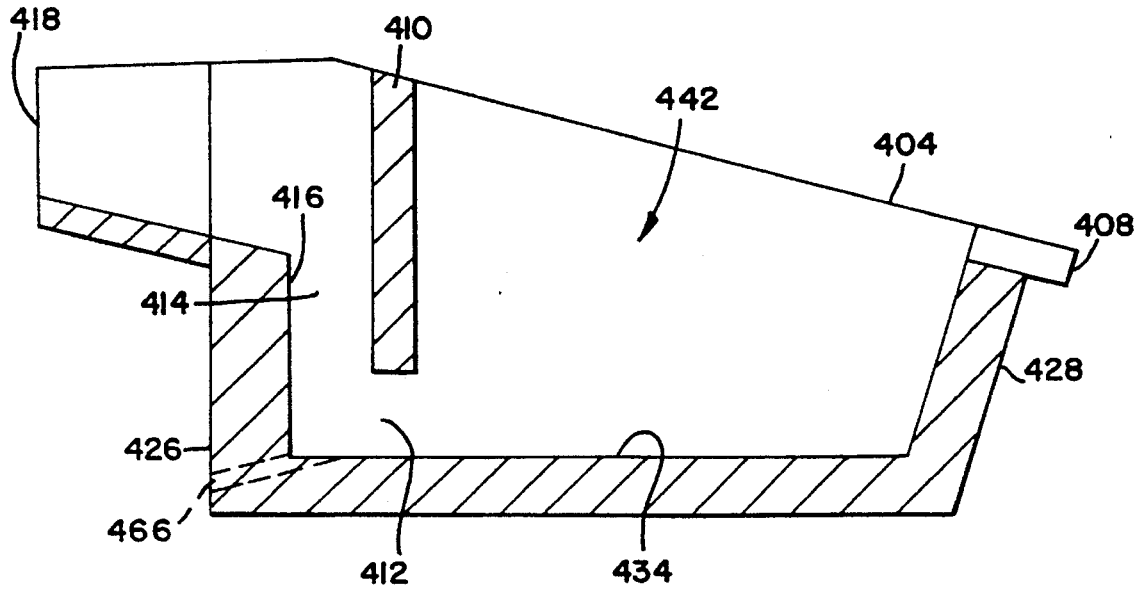
FIG. 22 is a cross-sectional view of the slag separating unit shown in FIG. 21 taken along the line 22—22 in FIG. 21.
Figure 23:
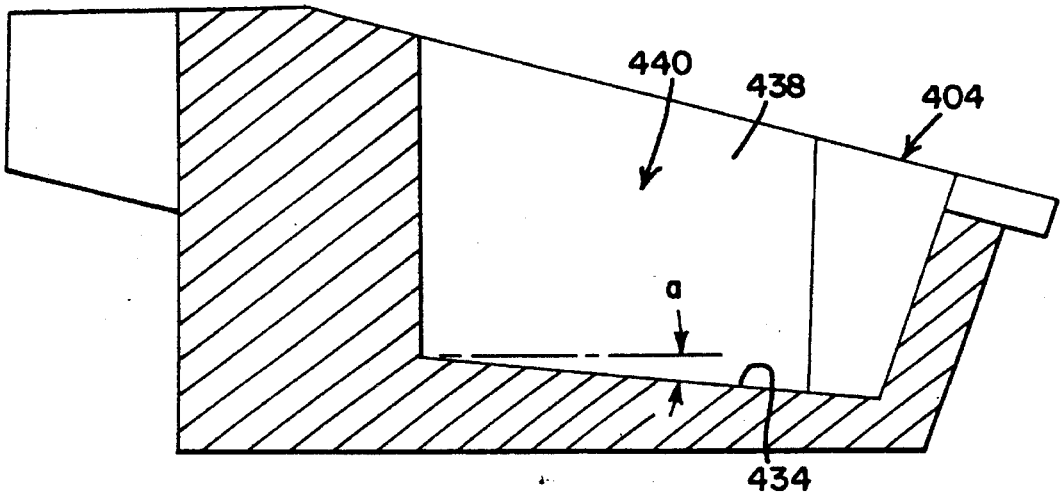
FIG. 23 is a cross-sectional view of the slag separating unit shown in FIG. 21 taken along the line 23—23 in FIG. 21.

Referring to FIGS. 21–23, an alternative embodiment of the tiltable vessel 404 has an intermediate wall 438 that is oriented at angle extending from the side wall 436. A first chamber 440 defined by the side wall 436 and the intermediate wall 438 is smoothly tapered between a narrow section 440*a* and a wider section 440*b*. A second chamber 442 defined by a side wall 430 and the intermediate wall 438 is smoothly tapered between a narrow section 442*a* and a wider section 442*b*. An opening 444 defined between the end of the intermediate wall 438 and the corner of the rear wall 428 and the side wall 430 connects the first chamber 440 and the second chamber 442.

As the molten metal flows from the narrow section 440*a* to the wider section 440*b* in the first chamber 440, the flow velocity and turbulence are substantially reduced. The flow is constricted and further slowed as it passes through the opening 444. This facilitates pooling and reduction of turbulence as discussed above.

In passing through the opening 444, the flow turns 180 degrees and enters the second chamber 442. As the flow passes from the narrow section 442*a* to the wider section 442*b* of the second chamber 442, the flow velocity and turbulence are substantially reduced. When the flow reaches the dam 410 at the downstream end of the second chamber 442, the slag has substantially separated from the molten metal and floats on top of the molten metal. The floating slag is retained by the dam 410 while the molten metal flows under the dam 410, through the dam opening 412 (FIG. 22), through the passage 414, and over the weir 416.

In this alternative embodiment, a drain hole 466 extends between the bottom of the passage 414 and the outside of the vessel 404. The bottom 436 of the second chamber 442 (FIG. 22) is substantially flat. The bottom 434 of the first chamber 440 (FIG. 23) is oriented at an angle a extending rearwardly and downwardly in order to facilitate draining of the molten metal from the first chamber 440 to the second chamber 442 and out of the drain hole 466 at the end of a pour. Preferably, the angle a is approximately 5 degrees.

In a preferred form of the vessel 404, the overall dimensions of the vessel 404 are 10 feet long with a height of 69 inches at the front end and a height of 36 inches at the rear wall 428. The overall width is 80 inches. The molten metal outlet 418 extends 25.5 inches from the front of the vessel 404. The inside width of the molten metal outlet 418 is approximately 25 inches. The depth of the molten metal outlet 418 is approximately 32 inches proximate the vessel 404 and is approximately 22 inches at the distal end. The slag outlet 408 is approximately 6 inches deep and 30 inches wide.

The dam 410 is about 6 inches thick, the front wall 426 is about 13.5 inches thick, the rear wall 428 is about 9 inches thick, the side walls 430 and 432 are about 9 inches thick, the bottom wall 434 is about 9 inches thick, and the intermediate wall 438 is about 12 inches thick.

The first chamber 440 of the reservoir 206 is about 78 inches long (as measured rearwardly from the front end 441 of the first chamber 440 to the proximal end of the intermediate wall 438) with a width of about 7 inches adjacent the front end 441 and a width of 34 inches adjacent the proximal end of the intermediate wall 438.

The second chamber 442 of the reservoir 206 is about 60.5 inches long (as measured rearwardly from the dam 410 to the proximal end of the intermediate wall 438) with a width of 25 inches adjacent the dam 410 and a width of 12 inches adjacent the proximal end of the intermediate wall 438.

The dam 410 has a height of about 48 inches and a width of about 25 inches with the dam opening 412 being about 12 inches high and 21.5 inches wide. The passage 414 is about 28 inches wide and 12 inches across, and is defined in part by a weir 416 that extends approximately 28 inches upwardly from the bottom wall 434.

Figure 25:
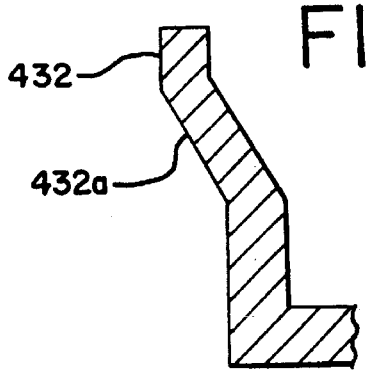
FIG. 25 is a cross-sectional view of a side wall of the unit taken along the line 25—25 in FIG. 21.

The distance from the intermediate wall 438 to the rear wall 428 adjacent the bottom wall 434 is approximately 12 inches. The rear wall extends upwardly and rearwardly from the bottom wall 434 at an angle of approximately 10 degrees. The distance from the intermediate wall 438 to the side wall 430 is approximately 18 inches. The drain hole 466 is about 3 inches in diameter. The side wall 432 has a sloped section **432*a* that is about 21 inches long and extends inwardly about 8 inches (see FIG. 25). It is to be understood, however, that the dimensions of the vessel 204** can be larger or smaller than described above.

To provide the desired flow of molten metal and slag out of the vessel 404, the top edge of each side wall 430 and 432 as well as the top edge of the intermediate wall 438 are oriented at an angle of approximately 15°–25° downwardly from the front wall 426. The front wall 426 is approximately 69 inches tall and the rear wall 428 is approximately 42 inches tall.

Figure 24:
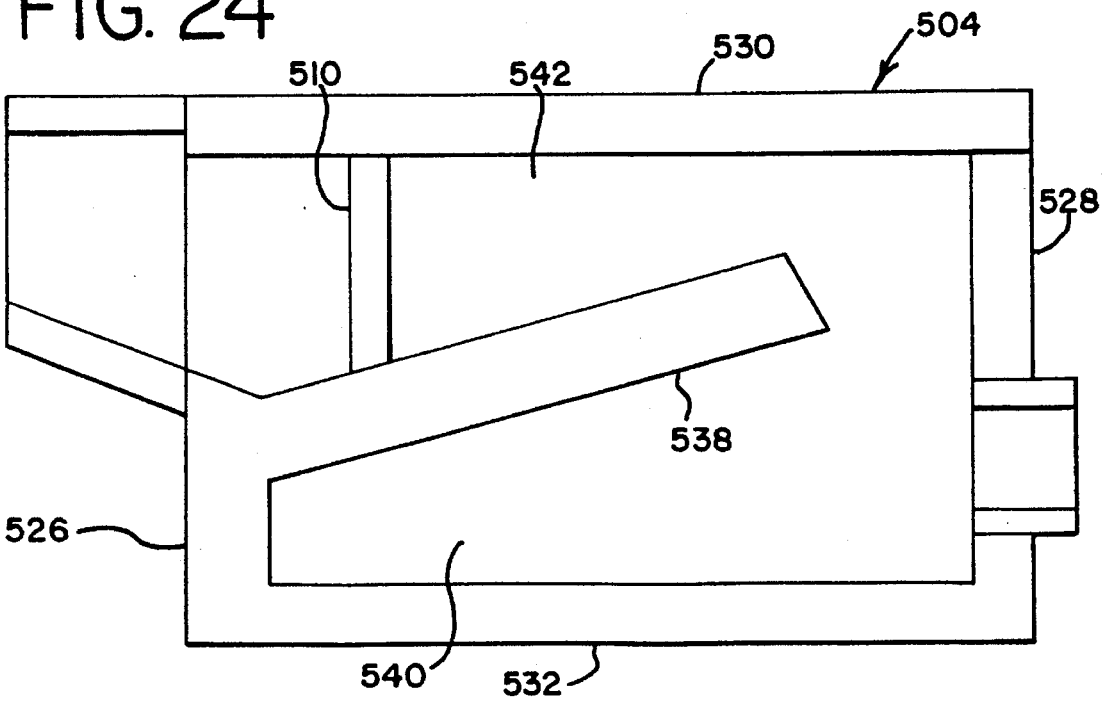
FIG. 24 is a plan view of alternative embodiment of a tiltable and movable slag separating unit in accordance with the invention.

In another embodiment of the vessel 504 in accordance with the invention as shown in FIG. 24, the intermediate wall 538 extends from the front wall 526 at an angle of approximately 25 degrees extending toward the corner of the vessel 504 (defined by a side wall 530 and rear wall 528). The intermediate wall 538 is approximately 17.5 inches from the side wall 532 adjacent the front wall 526. The intermediate wall 538 is spaced approximately 12 inches from the rear wall 528 and approximately 18 inches from the side wall 530. The dam 510 and dam opening are approximately 26 inches wide. Thus, chambers 540 and 542 are tapered to facilitate the reduction in velocity and turbulence of the flow of molten metal and slag as discussed above.

Further, although the invention has been described and depicted as in a preferred embodiment, it will be apparent that other variations and modifications as come within the scope of the appended claims can be considered part of the present invention without departing from the true spirit and scope of the novel concepts or principles of the invention.

What is claimed is:

1. A method for separating molten metal and slag comprising the steps of:

(a) providing a free-falling flow of molten metal and slag; and (b) providing a movable vessel having a reservoir including a flow path therethrough, said reservoir having a molten metal outlet, a slag opening, and a drain hole, said flow path including a first portion having an open top for receiving said flow of molten metal and slag, said first portion being configured to eliminate turbulence caused by said free-falling flow of molten metal and slag into said reservoir and to permit separation of said molten metal from said slag wherein said slag floats on top of said molten metal, said first portion of said flow path being configured to direct flow rearwardly, said flow path including a second downstream portion being configured to direct flow forwardly.

2. A method for separating molten metal and slag in accordance with claim 1 wherein said flow path is configured to reduce said turbulent flow to a substantially laminar flow therethrough.

3. A method for separating molten metal and slag in accordance with claim 1 wherein said step (a) includes providing a free-falling flow of molten metal and slag from a source, said source varying in position with respect to said vessel as said flow progresses.

4. A method for separating molten metal and slag in accordance with claim 1 including step (c) moving said vessel to a first position for accumulating said slag within said reservoir and discharging said molten metal out of said molten metal outlet.

5. A method for separating molten metal and slag in accordance with claim 4 including step (d) moving said vessel to a second position for discharging said molten metal out of said molten metal outlet and for discharging said slag out of said slag opening while continuing to receive said free-falling flow of molten metal and slag.

6. A method for separating molten metal and slag in accordance with claim 5 including step (e) moving said vessel to a third position after said free-falling flow of molten metal and slag has ceased wherein said discharge of molten metal and slag ceases and a minimal amount of slag is retained within said reservoir.

7. A method for separating molten metal and slag in accordance with claim 6 including step (f) discharging said molten metal and slag through said drain hole.

8. A method for separating molten metal and slag in accordance with claim 7 wherein said step (f) includes moving said vessel in at least one of a horizontal and vertical direction.

9. A method for separating molten metal and slag comprising the steps of:

(a) providing a flow of molten metal and slag;

(b) providing a movable vessel having a reservoir, said reservoir having a flow path therethrough, said flow path including a first chamber for receiving said flow and being configured for separating said molten metal and slag, said first chamber of said flow path being configured to direct flow rearwardly, said flow path including a second downstream chamber being configured to direct flow forwardly, said reservoir including a slag opening for discharge of said slag and a dam positioned at the end of said flow path, said dam including an opening proximate a bottom of said reservoir in operable communication with a passage, said passage including a weir and an outlet for said molten metal;

(c) locating said vessel in a first position which (1) accepts said flow within said first chamber of said flow path, (2) separates said molten metal from said slag, and (3) enables said molten metal to flow under the influence of gravity along said flow path, through said dam opening, into said passage, generally upward along said weir and out of said molten metal outlet while said slag accumulates in said reservoir; and (d) collecting said molten metal from said molten metal outlet.

10. A method for separating molten metal and slag in accordance with claim 9 wherein step (c) includes positioning said slag opening at a first elevation above said molten metal outlet.

11. A method for separating molten metal and slag in accordance with claim 9 including step (e) moving said vessel to a second heavy slag discharge position after collection of a substantial amount of molten metal and accumulation of a desired amount of slag in said reservoir, said second position providing a substantially rapid discharge of said slag out of said slag opening while continuing to receive said flow of molten metal and slag and continuing to discharge said molten metal from said molten metal outlet.

12. A method for separating molten metal and slag in accordance with claim 11 wherein step (e) includes positioning said slag opening in a second elevation above said molten metal outlet, said second elevation being less than said first elevation.

13. A method for separating molten metal and slag in accordance with claim 11 including step (f) moving said vessel to a third position after said flow of molten metal and slag into said vessel has ceased and after the majority of molten metal and slag has been discharged from said vessel, said third position retaining a minimal amount of molten metal and slag in said vessel.

14. A method for separating molten metal and slag in accordance with claim 13 including step (g) moving said vessel to a fourth position for enabling draining of said molten metal and slag remaining in said vessel.

15. A method for separating molten metal and slag in accordance with claim 9 wherein said flow is provided directly from a tap hole of a detached rotating furnace positioned above said vessel, said furnace being rotated to empty molten metal and slag contained therein, said furnace rotation providing said variable flow position with respect to said vessel.

16. A method for separating molten metal and slag comprising the steps of:

(a) providing a tiltable vessel having a reservoir; said reservoir including a flow path therethrough, said flow path including a first portion being configured to direct flow rearwardly, said flow path including a second downstream portion being configured to direct flow forwardly, a slag opening for discharge of said slag, and a dam positioned at the end of said flow path; said dam including an opening proximate a bottom of said reservoir in operable communication with a passage, said passage including a weir and an outlet for said molten metal;

(b) locating said vessel in a first position which enables said molten metal to flow under the influence of gravity along said flow path, through said dam opening, into said passage, generally upward along said weir and out of said outlet while enabling said slag to accumulate in said reservoir;

(c) providing a flow of molten metal and slag into said reservoir; and (d) moving said vessel to a second heavy slag discharge position upon accumulation of a desired amount of said slag in said reservoir where said slag rapidly can be discharged through said slag opening while said molten metal continues to flow out of said outlet.

17. A method for separating molten metal and slag in accordance with claim 16 including step (e) moving said vessel to a third position after said flow into said reservoir has ceased and after a majority of said molten metal and said slag have been discharged from said vessel where any residual molten metal and slag are retained within said vessel.

18. A method for separating molten metal and slag in accordance with claim 17 including step (f) moving said vessel to a fourth position for enabling draining of said molten metal and slag retained in said vessel.

19. An apparatus for separating molten metal and slag comprising:

a vessel having a reservoir including a flow path therethrough, said flow path including a first portion for receiving a free-falling, turbulent flow of molten metal and slag, said first portion being configured to eliminate said turbulence in said flow and to permit separation of said molten metal and slag wherein said slag floats on top of said molten metal, said flow path including a second downstream portion, said second portion including a dam at a downstream end thereof for retaining said floating slag while permitting said molten metal to flow thereunder and out of said vessel, said vessel having a flow constriction located between said first portion and said second portion, said vessel having a slag opening adjacent said first and second portions of said flow path to permit discharge of said floating slag.

20. An apparatus for separating molten metal and slag in accordance with claim 19 wherein said flow path is configured to reduce said turbulent flow to a substantially laminar flow therethrough.

21. An apparatus for separating molten metal and slag in accordance with claim 20 wherein said first portion includes a narrow section and a wide section, said wide section being located downstream of said narrow section.

22. An apparatus for separating molten metal and slag in accordance with claim 21 wherein said first portion of said reservoir is tapered between said narrow section and said wide section.

23. An apparatus for separating molten metal and slag in accordance with claim 19 wherein said first portion of said reservoir has an elongated receiving zone for receiving said free-falling flow.

24. An apparatus for separating molten metal and slag in accordance with claim 19 wherein said second downstream portion of said reservoir includes a narrow section and a wide section, said wide section being located downstream of said narrow section.

25. An apparatus for separating molten metal and slag in accordance with claim 24 wherein said second portion of said reservoir is tapered between said narrow section and said wide section.

26. An apparatus for melting molten metal and slag in accordance with claim 19 wherein said flow path is generally U-shaped.

27. An apparatus for separating molten metal and slag in accordance with claim 19 wherein said flow path includes at least one substantially abrupt change in the flow direction to assist in separating said molten metal and slag and accumulating said slag in said reservoir.

28. An apparatus for separating molten metal and slag in accordance with claim 19 wherein said vessel is tiltable to an operating position wherein said first portion of said flow path includes an upward slope when said vessel is in said operating position.

29. An apparatus for separating molten metal and slag in accordance with claim 28 wherein said second portion of said flow path includes a downward slope when said vessel is in said operating position.

30. An apparatus for separating molten metal and slag in accordance with claim 19 wherein said flow path includes a passage located downstream of said second portion for discharge of said molten metal out of said vessel, said vessel having a channel distinct from said flow path and interconnecting said first portion of said flow path to said passage for charging said passage with molten metal.

31. A method for separating molten metal and slag comprising the steps of:

(a) receiving a flow of molten metal and slag into a vessel;

(b) directing said molten metal and slag in the vessel from a relatively narrow portion of said vessel into a relatively wide portion of said vessel so as to slow the velocity of said flow and permit pooling of said molten metal and slag, said vessel defining a flow path, said flow path including a first portion being configured to direct flow rearwardly, said flow path including a second downstream portion being configured to direct flow forwardly;

(c) providing a slag opening adjacent said wide portion for discharge of floating slag; and (d) providing a dam downstream of said wide portion for retaining said slag in said wide portion and permitting discharge of molten metal under said dam and out of said vessel.

32. A method for separating molten metal and slag in accordance with claim 31 including step (e) directing said flow in said wide portion around a bend.

33. A method for separating molten metal and slag in accordance with claim 32 wherein said bend is at least 90 degrees.

34. A method for separating molten metal in accordance with claim 32 wherein said bend has a flow restriction.

35. A method for separating molten metal and slag in accordance with claim 31, wherein said vessel includes a discharge outlet for discharge of said molten metal, said outlet being located on a side of said vessel opposite said slag opening, said method including the following steps:

(e) tilting said vessel toward said discharge outlet for discharge of said molten metal; and (f) tilting said vessel toward said slag opening for discharge of said slag.

36. A method for separating molten metal and slag in accordance with claim 31 including further step (e) directing said molten metal over a weir after it passes under said dam.

37. A method for separating molten metal and slag in accordance with claim 31 wherein step (d) includes maintaining a minimum depth of molten metal in said vessel.

38. A method for separating molten metal and slag comprising the steps of:

(a) receiving a turbulent flow of molten metal and slag into tiltable vessel, said vessel defining a flow path, said flow path including a first portion being configured to direct flow rearwardly, said flow path including a second downstream portion being configured to direct flow forwardly;

(b) reducing said turbulent flow to a non-turbulent flow in said vessel so as to permit separation of said molten metal and slag wherein said slag floats on top of said molten metal while said vessel tilts for discharge of said molten metal;

(c) providing a slag opening in the perimeter of said vessel adjacent said non-turbulent flow for discharge of floating slag; and (d) providing a dam in said vessel for retaining said slag in said vessel and permitting discharge of molten metal under said dam and out of said vessel.

39. A method for separating molten metal and slag in accordance with claim 38 including further step:

(e) maintaining a minimum depth of molten metal in said vessel.

40. A method for separating molten metal and slag in accordance with claim 38 wherein step (d) includes providing a weir downstream of said dam for directing said flow of molten metal over said weir.

41. A method for separating molten metal and slag comprising the steps of:

(a) receiving a flow of molten metal and slag into a tilting vessel;

(b) directing said flow of molten metal and slag through a U-shaped reservoir having an upstream chamber and a downstream chamber, said upstream chamber being configured to permit pooling of said molten metal and slag so as permit separation of said molten metal and slag wherein said slag floats on top of said molten metal while said vessel is tilted;

(c) providing a slag opening adjacent said upstream chamber for discharge of floating slag; and (d) providing a dam in said downstream chamber for retaining said slag in said vessel and permitting discharge of molten metal under said dam and out of said vessel.

42. A method for separating molten metal and slag in accordance with claim 41 wherein step (b) includes reducing said flow of molten metal and slag from turbulent flow to non-turbulent flow.

43. A method for separating molten metal and slag in accordance with claim 41 wherein step (b) includes reducing the velocity of said flow within said upstream chamber.

44. A method for separating molten metal and slag in accordance with claim 50 wherein step (b) includes directing said flow around a baffle in said upstream chamber.

45. A method for separating molten metal in accordance with claim 41 wherein step (b) includes reducing the velocity of said flow within said downstream chamber.

46. A method for separating molten metal in accordance with claim 41 including further step:

(e) providing a narrow flow constriction between the upstream chamber and the downstream chamber.

47. An apparatus for separating molten metal and slag comprising:

a tilting vessel having an open top, said vessel having a first chamber and a second chamber, said first chamber being configured for receiving a flow of molten metal and slag, said first chamber having a relatively narrow section and a relatively wide section, said second chamber being adjacent said wide section;

a slag opening defined in said vessel and adjacent said wide section for discharge of floating slag; and a dam at a downstream end of said second chamber for retaining said slag in said vessel and permitting discharge of molten metal under said dam and out of said vessel.

48. An apparatus for separating molten metal and slag in accordance with claim 47 wherein said first chamber is tapered between said narrow section and said wide section.

49. An apparatus for separating molten metal and slag in accordance with claim 47 wherein said vessel includes a metal discharge opening, said discharge opening and said slag opening being located at opposite ends of said vessel.

50. An apparatus for separating molten metal and slag in accordance with claim 49 wherein said vessel is tiltable in the direction of said discharge opening.

51. An apparatus for separating molten metal and slag in accordance with claim 49 wherein said vessel is tiltable in the direction of said slag opening.

52. An apparatus for separating molten metal and slag in accordance with claim 47 wherein said first and second chambers define a U-shaped flow path.

53. An apparatus for separating molten metal and slag in accordance with claim 52 wherein said vessel is tiltable to a metal discharging position, said first chamber being oriented at an angle rearwardly and upwardly and said flow path in said first chamber being uphill when said vessel is in said metal discharging position.

54. An apparatus for separating molten metal and slag in accordance with claim 53 wherein said second chamber is oriented at an angle forwardly and downwardly and said flow path in said second chamber is downhill when said vessel is in said metal discharging position.

55. An apparatus for separating molten metal and slag in accordance with claim 47 including a weir downstream of said dam for maintaining a minimum depth of flow in said vessel.

56. An apparatus for separating molten metal and slag in accordance with claim 47 including a drain hole in the bottom of said vessel.

57. An apparatus for separating molten metal and slag comprising:

a tilting vessel having an open top, said vessel having a first chamber and a second chamber connected to each other, said first chamber and said second chamber defining a U-shaped flow path, said first chamber being configured to receive a flow of molten metal and slag and to permit pooling and separation of said molten metal and slag wherein said slag floats on top of said molten metal;

a slag opening defined in a side of said vessel for discharge of floating slag; and a dam adjacent the downstream end of said second chamber for retaining said slag in said vessel and permitting discharge of molten metal under said dam and out of said vessel.

58. An apparatus for separating molten metal and slag in accordance with claim 57 wherein said first chamber has a narrow section and a wide section, said wide section being adjacent to said second chamber.

59. An apparatus for separating molten metal and slag in accordance with claim 58 wherein said first chamber is tapered.

60. An apparatus for separating molten metal and slag in accordance with claim 59 including a weir located downstream of said dam for maintaining a minimum depth of flow in said vessel.

61. An apparatus for separating molten metal and slag comprising:

a tilting vessel having an open top, said vessel having a first chamber and a second chamber, said chambers being laterally offset and being separated by an intermediate wall, said intermediate wall being oriented at an angle whereby each chamber has a relatively narrow section and a relatively wide section and each of said chambers is tapered, said vessel defining a flow path from said first chamber to said second chamber;

a slag opening defined in a side of said vessel for discharge of floating slag; and a dam adjacent said second chamber for retaining said slag in said vessel and permitting discharge of molten metal under said dam and out of said vessel.

62. An apparatus for separating molten metal and slag in accordance with claim 61 including a flow constriction between said first chamber and said second chamber.

63. An apparatus for separating molten metal and slag in accordance with claim 62 wherein said flow constriction is defined in part by the proximity of the end of said intermediate wall and the perimeter of said vessel.

64. An apparatus for separating molten metal and slag in accordance with claim 62 wherein said flow constriction includes a 180° change in flow direction.

65. An apparatus for separating molten metal and slag in accordance with claim 61 wherein said flow moves from said narrow section to said wide section in each of said chambers.

66. An apparatus for separating molten metal and slag in accordance with claim 61 wherein said intermediate wall is relatively planar and wherein each of said chambers has a smooth taper from said wide section to said narrow section.

* * * * *